United States Patent [19]

Lim et al.

[11] Patent Number: 4,712,620

[45] Date of Patent: Dec. 15, 1987

[54] UPPER MARINE RISER PACKAGE

[75] Inventors: Jack S. Lim, Ventura; Darrell L. Jones, Ojaj, both of Calif.

[73] Assignee: Vetco Gray Inc., Houston, Tex.

[21] Appl. No.: 696,823

[22] Filed: Jan. 31, 1985

[51] Int. Cl.[4] ..... E21B 17/01; E21B 33/035

[52] U.S. Cl. ..... 166/355; 166/359; 166/365; 166/367; 285/165; 285/302; 405/195

[58] Field of Search ..... 285/164, 165, DIG. 3, 285/302, 275, 261, 263, 271-280; 405/169, 195; 166/355, 359, 365, 367; 175/7, 321

[56] References Cited

U.S. PATENT DOCUMENTS

| | | | |
|---|---|---|---|
| 2,864,630 | 12/1958 | Breitenstein | 285/271 |
| 2,955,850 | 10/1960 | Bellinger | 285/302 |
| 3,110,350 | 11/1963 | Spiri . | |
| 3,196,958 | 7/1965 | Travers et al. | 175/7 |
| 3,211,224 | 10/1965 | Lacy . | |
| 3,217,895 | 11/1965 | Howard . | |
| 3,301,324 | 1/1967 | Smith | 285/272 |
| 3,313,345 | 4/1967 | Fischer . | |
| 3,353,851 | 11/1967 | Vincent . | |
| 3,427,051 | 2/1969 | White et al. . | |
| 3,601,187 | 8/1971 | Tidwell | 175/7 |
| 3,643,751 | 2/1972 | Crickmer . | |
| 3,647,245 | 3/1972 | Hanes et al. . | |
| 3,687,205 | 8/1972 | Mori . | |
| 3,752,507 | 8/1973 | Naurer et al. | 285/275 |
| 3,757,060 | 8/1973 | Warren | 285/276 |
| 3,764,168 | 10/1973 | Kisling et al. . | |
| 3,791,442 | 2/1974 | Watkins . | |
| 3,897,045 | 7/1975 | Butler . | |
| 3,933,108 | 1/1976 | Baugh . | |
| 3,955,621 | 5/1976 | Webb . | |
| 4,057,267 | 11/1977 | Jansen . | |
| 4,118,954 | 10/1978 | Jenkins . | |
| 4,146,253 | 3/1979 | Celommi | 285/302 |
| 4,176,722 | 2/1979 | Wetmore et al. . | |
| 4,211,290 | 7/1980 | Mason et al. . | |
| 4,215,950 | 8/1980 | Stevenson . | |
| 4,221,408 | 9/1980 | Lochte et al. | 285/276 |
| 4,317,586 | 3/1982 | Campbell | 285/302 |
| 4,367,981 | 1/1983 | Shapiro . | |
| 4,379,657 | 4/1983 | Widiner et al. . | |
| 4,502,543 | 3/1985 | Outhwaite | 166/359 |
| 4,516,881 | 5/1985 | Beynet et al. | 166/367 |

FOREIGN PATENT DOCUMENTS

| | | | |
|---|---|---|---|
| 0088608 | 4/1985 | European Pat. Off. . | |
| 2023205 | 12/1979 | United Kingdom | 166/367 |

*Primary Examiner*—Stephen J. Novosad
*Assistant Examiner*—Bruce M. Kisliuk
*Attorney, Agent, or Firm*—Joseph R. Dwyer

[57] ABSTRACT

An upper marine riser package (10/10A) comprising a diverter (D) for diverting uncontrolled gas and return drilling mud therethrough, a flexible joint FJ for allowing tilting motion between a vessel and a riser string (RS), a self-tensioning slip joint (SJ) and riser rotation bearing joint (RB) suspended below said vessel (V) to compensate for vertical motion between a subsea well (W) and a floating vessel (V). The upper marine riser package (10/10A) is sized to be run through a confined opening such as a riser handling spider (HS) and rotary table (RT) and to be suspended and operated below the deck of the vessel (V). The upper marine riser package can be used to eliminate the conventional riser tensioners normally above the platform and can be used in combination with such conventional riser tensioners normally above the platform for deeper and deeper drilling opertion. Two versions of the upper marine riser package (10/10A) ar disclosed, one (10) with an elastomeric bearing type flexible joint (FJ) and the other (10A) with a ball joint.

51 Claims, 33 Drawing Figures

Fig. 14.
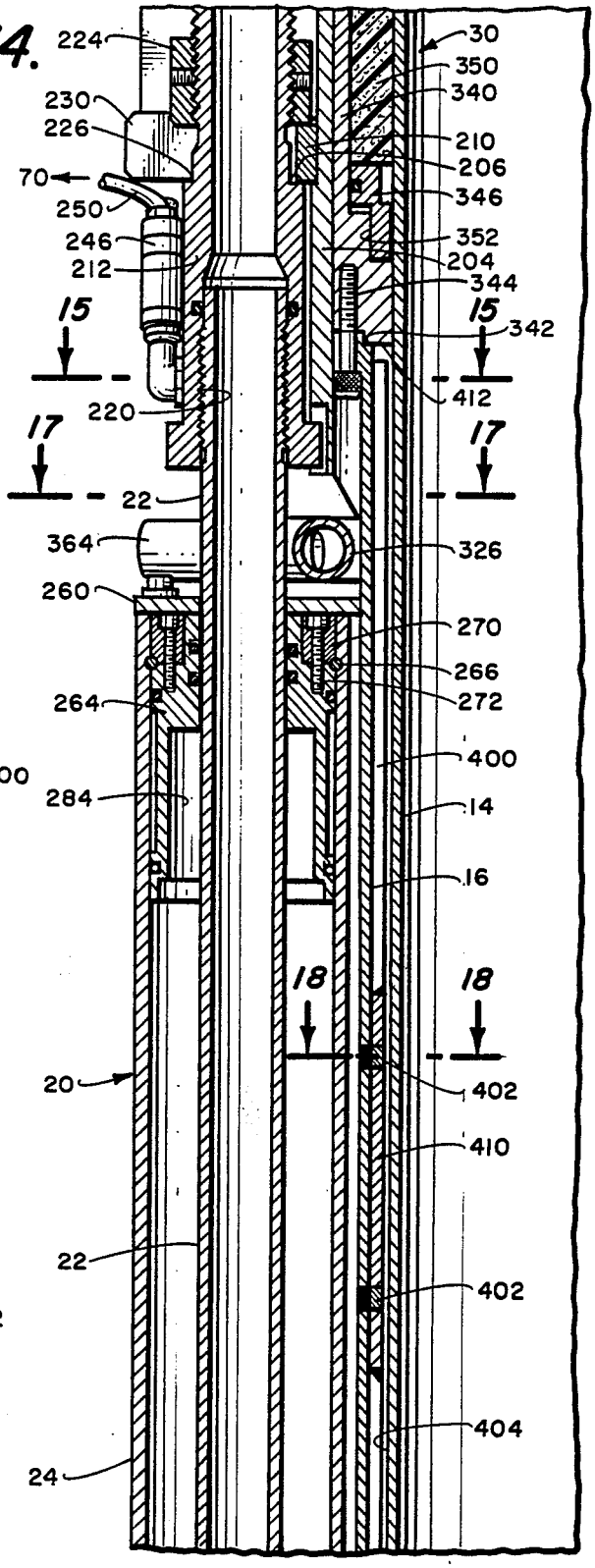
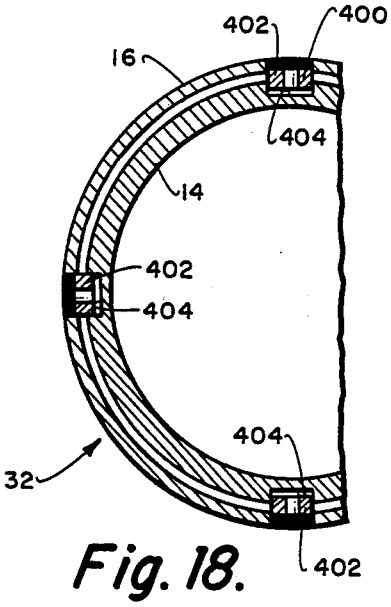
Fig. 18.

UPPER MARINE RISER PACKAGE

BACKGROUND OF THE INVENTION

This invention relates to offshore oil well operations and is specifically directed to a new and improved marine riser system for connecting marine risers extending from a well located on the ocean floor (subsea) to the platform of a vessel. Marine risers are sections of pipes sometimes called "conductors" or "casings" connected together as a "string" of "risers" and the vessels are suitably outfitted "ships" or "semi-submersibles", also referred to as "rigs".

In particular, the object of this invention is to provide a new and improved upper marine riser package which includes a self-tensioning riser slip joint and other equipment connectable, as a modular unit, to the upper end of the riser string and capable of being lowered through the rotary table on the vessel. Modularity of the package also facilitates retrieval for repair and maintenance.

This upper marine riser package may, in one application, eliminate all of the equipment of the conventional riser tensioning system, i.e., guide sheaves, wire ropes, and riser tensioners, as well as all of the necessary replacement equipment required to be stored on board the rig due to frequent breakage, such as extra reels of wire rope, extra sheaves, etc. In another application, this invention may be used where there are additional load requirements, such as in deeper water drilling, by providing additional load capabilities to the conventional riser tensioning systems. Thus, this invention can be used on newly constructed rigs either alone or as an addition to conventional tensioning systems or can be used as a retrofit for existing rigs to eliminate the conventional riser tensioning systems or as an addition to the conventional riser tensioning systems.

The need for slip joints and tensioning devices for marine risers supported from a platform of a vessel to a subsea well are amply described in any number of prior art patents such as in the U.S. Pat. No. 3,933,108 to Baugh directed to tanks to make the riser sections substantially bouyant, in the U.S. Pat. No. 4,367,981 to Shapiro directed to a slip joint form of a piston-cylinder configuration mounted at the upper portion of the riser, in the U.S. Pat. No. 3,353,851 to Vincent and in the U.S. Pat. No. 3,211,224 to Lacey, one of which shows a slip joint at the upper end of the riser string and the other at the lower end of the riser string.

However, none of the prior art patents cited above, as examples, suggest an upper marine riser package as an integral unit which could be made up and run, or retrieved for repair and maintenance, through the rig rotary table. Further, none of these patents suggest a package which, when used alone, would eliminate the aforementioned conventional riser tensioning systems or, alternatively, when used with such conventional systems, would provide additional load capabilities for longer and longer strings of risers for deeper and deeper subsea operations.

SUMMARY OF THE INVENTION

In the first embodiment of this invention, the upper marine riser package comprises four main components—a diverter, a flexible joint, a self-tensioning riser slip joint, and a riser rotation bearing joint, all of which may be lowered through the rotary table and supported on a diverter housing.

In use, the self-tensioning riser slip joint and the riser rotation bearing are connected as a modular unit to the upper end of a riser string, while the self-tensioning slip joint is being held in the marine riser handling spider on the drill floor of the rig. The flexible joint and diverter are then connected together and attached to the top of the self-tensioning riser slip joint. The entire package is then lowered through the diverter housing using a handling sub. The diverter lands in its housing and is locked down, thus supporting the entire upper marine riser package and all that it carries. Retrieval of the package for repair and maintenance is simply a reverse of the make-up procedure.

In the second embodiment of the invention, the upper marine riser package includes an upper ball joint and extension, in lieu of the flexible joint, which provides tilt action between the rig and the marine riser string, and is centrally apertured so that the self-tensioning riser slip joint and riser rotation bearing joint, as well as the risers, riser connection, etc., are lowered therethrough. The upper ball joint is installed in its housing which is attached to and supported by the drill floor substructure.

In use, the self-tensioning riser slip joint and the riser rotation bearing are connected as a modular unit to the upper end of a riser string and lowered through the rotary table and supported by the ball joint extension. Again, retrieval of the equipment for repair and maintenance is simply a reverse of the makeup procedure.

As will be understood by those skilled in the art from the Drawings and the Detailed Description hereinafter, both embodiments of the upper marine riser package of this invention has several unique features;

the diverter housing houses the diverter and supports the self-tensioning slip joint and riser rotation bearing as well as the risers, riser connectors, etc., the slip joint inner and outer barrels are keyed together to transmit initial vessel yaw or angular torque, thus relieving the cylinder rods of the slip joint from severe bending loads, the riser rotation bearing joint at the lower end of the package handles large angular rotation of the vessel, the self-tensioning joint is a compact module which with its multiple peripheral cylinders can be run through a rotary table and supported without complex handling procedures, the multiple peripheral cylinders are designed for easy change out on the rig, a hose/stab carrier, once installed, is a preassembly ready to interface with the upper riser, the packer seal assemblies can be easily replaced through the diverter housing, the locking mechanism which locks the slip joint in a lock-up position during the transporting stage is releasable by air/mechanical means, and the upper stab subs and the lower extension subs of the cylinders engage the upper and lower support plates through their side slots and are finally secured by lock nuts in the same manner as a choke and kill line is secured.

Therefore, the principal advantages offered by the upper marine riser package are:

A. the unitization of upper riser components into a single package,

B. a more direct loading of supporting structure,

C. faster deployment of the slip joint,

D. less equipment and volume on the rig as compared to that of a conventional system, E. the system is cost effective, F. adaptable to deep water applications, and G. is usable either alone, in place of the conventional riser tensioning system, or with conventional riser tensioning system to increase the load capabilities of the system.

In addition to the prior art patents mentioned above in the Background, there are also a number of patents which should be considered in connection with this invention.

Numerous attempts have been made to rid the vessel of the equipment in conventional riser tensioning systems. One such patent is the U.S. Pat. No. 4,215,950 to Stevens in which the elimination of the wire rope and sheaves was considered an important feature, but the tensioning cylinder and piston units, being coupled to and extending above the platform, interfere with other drilling operations and the handling of other equipment, such as the blow-out preventor stack, on the rig. Inasmuch as the peripheral cylinders of the present invention are completely free of the platform, there is no interference with other equipment being handled on the platform and/or being run through the risers during the operation. This feature is also important if the present invention is to be used with a conventional system to increase the load capabilities thereof, as mentioned above.

In the European patent application No. 0,088,608 of Elliston published Sept. 14, 1983 in bulletin 83/7, there is shown a motion compensating apparatus with a spherical or conical laminated body of superimposed layers of the elastomer material for a universal type joint. This joint is, first of all, above the floor and, secondly, does not permit the lowering of the flexible joint, the slip joint and other equipment through the diverter housing and rotary table or, in the case of the second embodiment, through the ball joint and rotary table. Swivel joints are shown in the U.S. Pat. No. 3,313,345 to Fischer. However, like the apparatus of the Elliston Application, the housing for such tilt joint and the tilt joint itself does not permit the lowering of the slip joint and other equipment through diverter housing and rotary table or, in the case of the second embodiment, through the ball joint and rotary table. Universal joints for riser strings are also shown in the U.S. Pat. No. 3,110,350 to Spieri, but again the concept of lowering the riser string, the slip joint, etc., through the diverter housing or rotary table or, in the case of the second embodiment, through the ball joint and rotary table, was not considered.

Reference should also be made to the U.S. Pat. No. 4,068,868 to Ohrt which shows a flexible joint used with conventional riser tensioning systems where the latter carry most of the load of the risers and other equipment.

BRIEF DESCRIPTION OF THE DRAWINGS

FIG. 14 is an elevational cross-sectional view of the lock up dogs, the upper part of the cylinder assemblies and inner and outer barrels, taken along line 14—14 of FIG. 7, FIG. 18 is a cross-sectional view of part of the reaction ring, taken along line 18—18 of FIG. 14.

DETAILED DESCRIPTION

Figure 1:
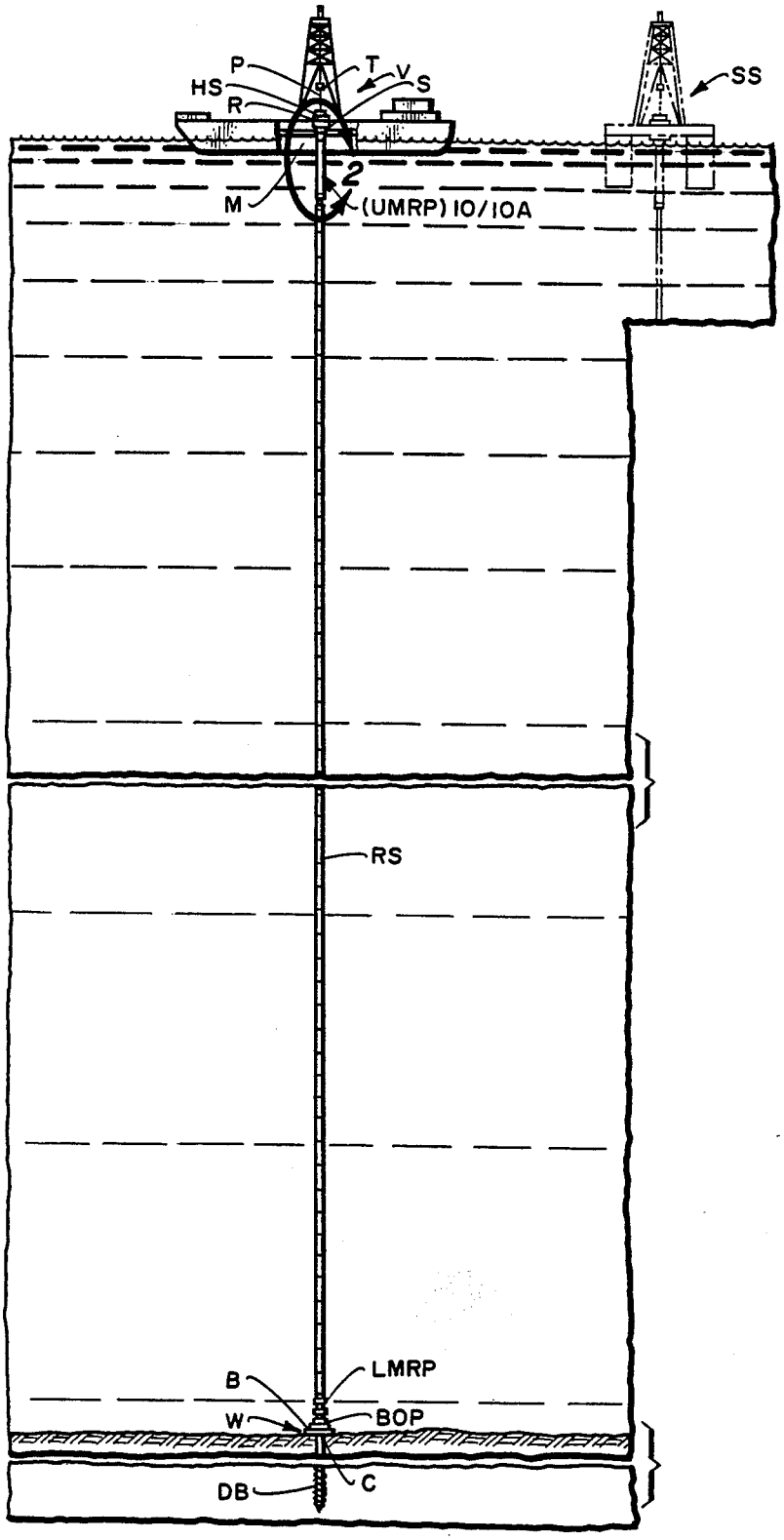
FIG. 1 is an overall elevational view of this invention in operating position.

Referring to FIG. 1, vessel V is a drill ship (although a semi-submersible SS shown in phantom may also be used) and is shown floating on a body of water, such as an ocean. The vessel includes a vertical opening or "moon pool" M through its hull near the longitudinal and transverse center of the vessel. Supported on the upper deck of the vessel and approximately centered over the moon pool is a derrick from which the upper end of drill pipe P is supported by a traveling block T. The derrick and much of the associated equipment are of a type commonly used in offshore rotary drilling and are not shown in detail. Approximately centered in the base of the derrick are a support platform S, a riser handling spider HS, and a rotary table R. The drill pipe P passes vertically through aligned openings in the platform and rotary table and is rotated by the rotary table R in a standard manner. Anchors may be used to limit the movement of the vessel from its normal position over the well or, in deep water drilling, the vessel may be positioned dynamically.

A wellhead W is located on the submerged formation in which the hole is being drilled. The wellhead includes a base B and several lengths of well casing C extending beneath the wellhead into the well. In shallow water, drilling guide lines (not shown) extending between the vessel and the base B are used to guide equipment as it is lowered from the vessel to the wellhead, but in deep water drilling, such equipment is lowered and positioned on the wellhead by sonar, T.V., etc.

With the wellhead in place on the ocean bottom, a riser string RS, a lower marine riser package LMRP and blowout preventer BOP, are lowered to connect the vessel to the wellhead. This riser string is releasably connected at its lower end to the wellhead and is connected at its upper end to the vessel in a manner which will be described below.

High density drilling fluid from a mud system on the vessel is fed to the well from a pump to a drill bit DB at the bottom of the well and is returned to the sump by passing upwardly around the outside of drill pipe through well casings C, through the wellhead and then upward through the riser string where it is returned to the mud system.

As mentioned above, the upper end of the riser string is connected to the vessel, and this connection is accomplished preferably by an upper marine riser package (UMRP) 10 comprising this invention, shown in FIG. 1, connected to the support platform S. The first embodiment of this package 10 will be described in detail with reference to FIGS. 2–27.

First Embodiment—Flexible Joint Version

Thus, it can be seen that the upper marine riser package 10 includes four main components—a diverter D cooperable with a housing DH (FIGS. 2, 4, 11 and 12), a flexible joint FJ (FIGS. 2 and 11), a self-tensioning riser slip joint SJ (FIGS. 2, 5, 6, 7, 8, 13 and 21), and a riser rotation bearing joint RB (FIGS. 2, 9, 10, 22 and 23). In use, the self-tensioning riser slip joint SJ, and riser rotation bearing RB, can be connected, as a modular unit, to the upper end of the riser string. The flexible joint FJ and diverter D are then attached to the self-tensioning slip joint. As a package, it is then lowered through the rotary table of the rig with the diverter D finally locked in place in the diverter housing DH.

Figures 2, 3:
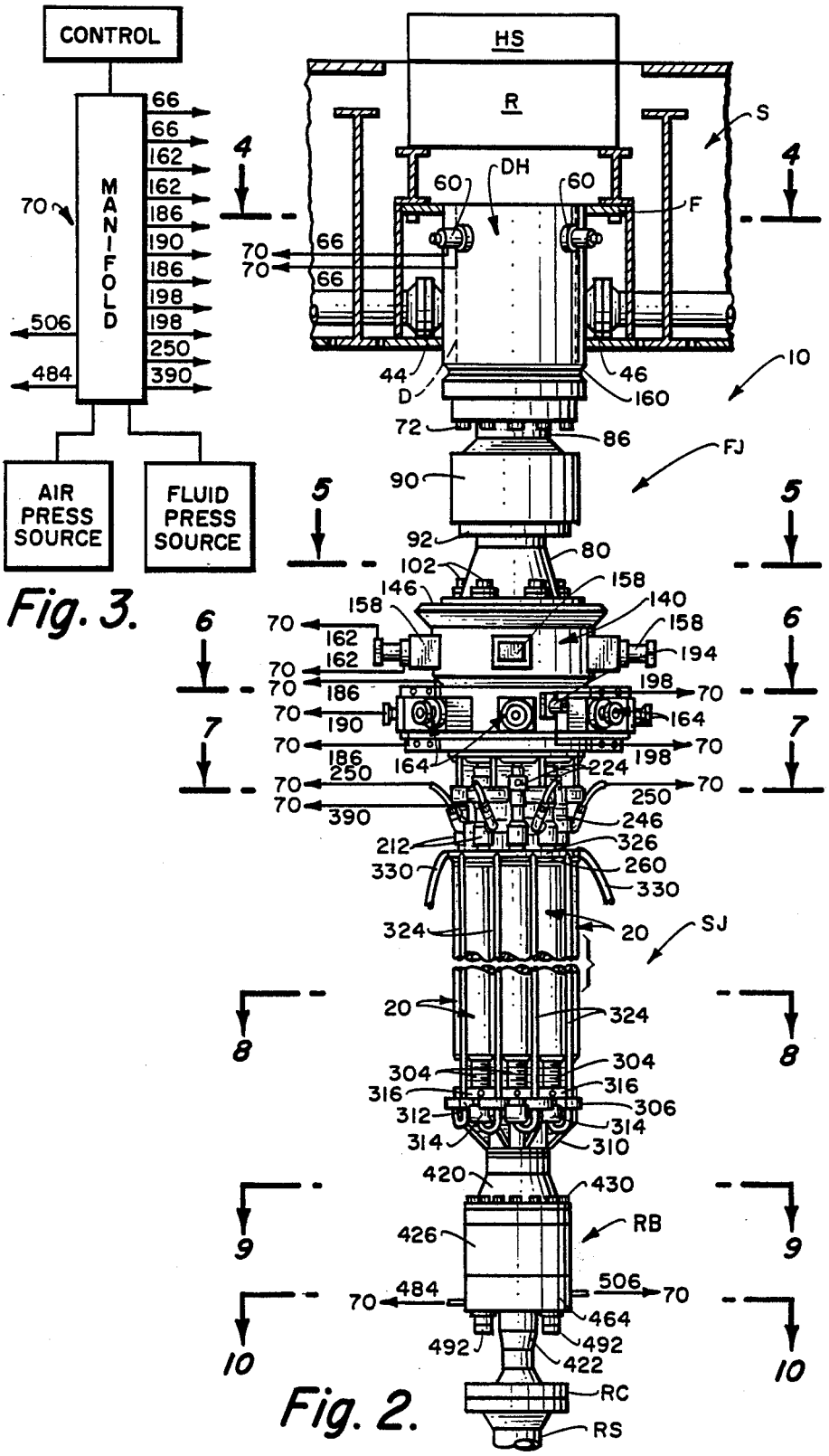
FIG. 2 is an elevational view of the upper marine riser package of the first embodiment of this invention and of the area encircled by the arrow 2 and, enlarged over the view of FIG. 1, and shown with the self-tensioning slip joint in its lock-up position.
FIG. 3 is a schematic illustration of a conventional operator controlled pressure system.
Figure 4:
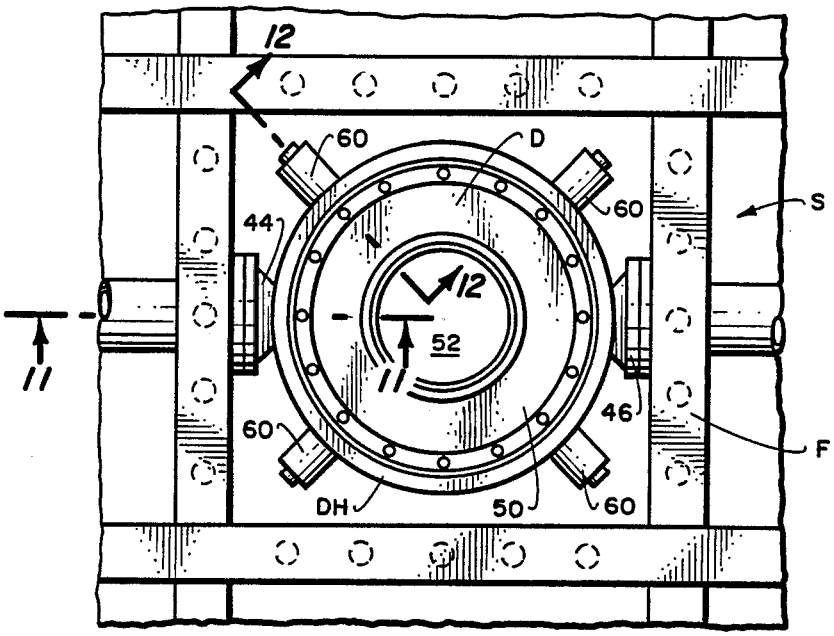
FIG. 4 is a top plan view of the invention showing the bore of the diverter, taken along line 4—4 of FIG. 2.
Figure 5:
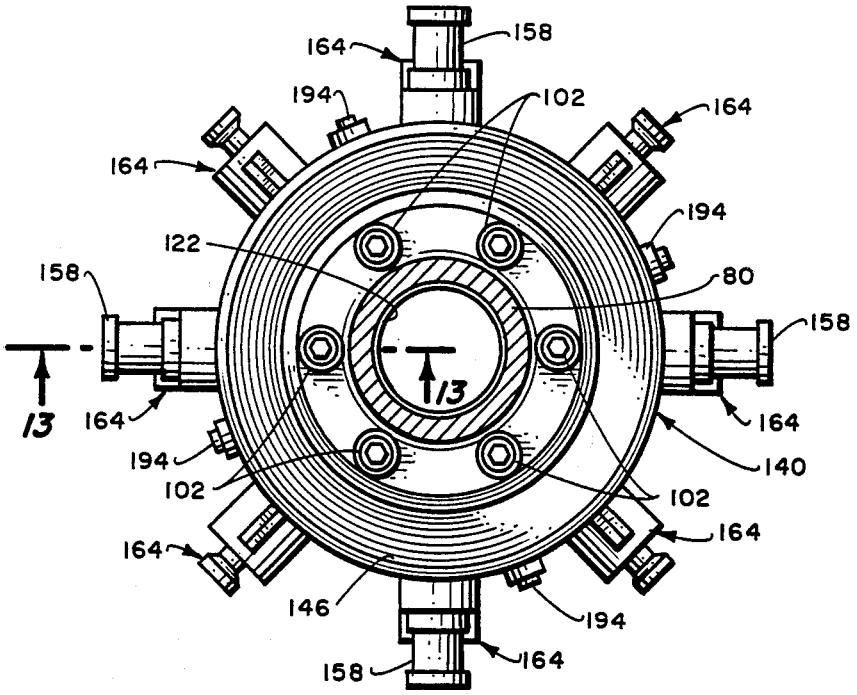
FIG. 5 is a cross-sectional view showing the top of the flexible joint and taken along line 5—5 of FIG. 2.
Figure 6:
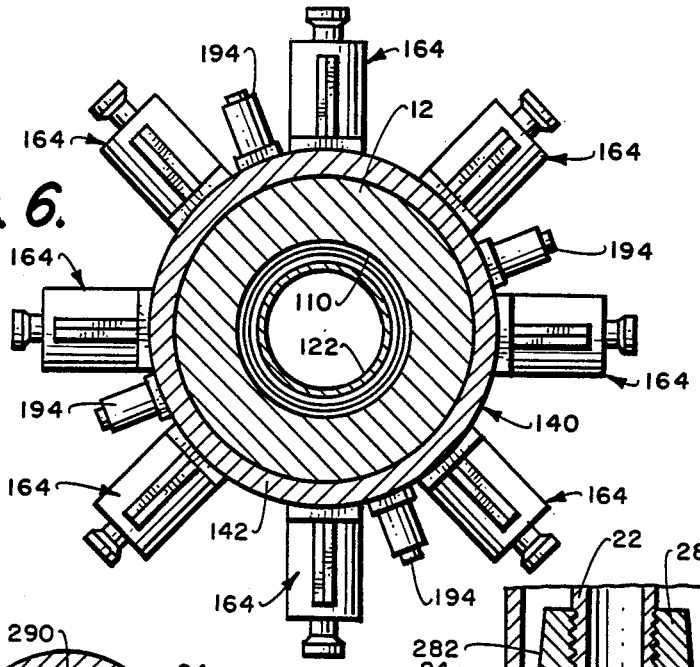
FIG. 6 is a cross-sectional view of the hose/stab carrier, taken along line 6—6 of FIG. 2.
Figures 11, 12:
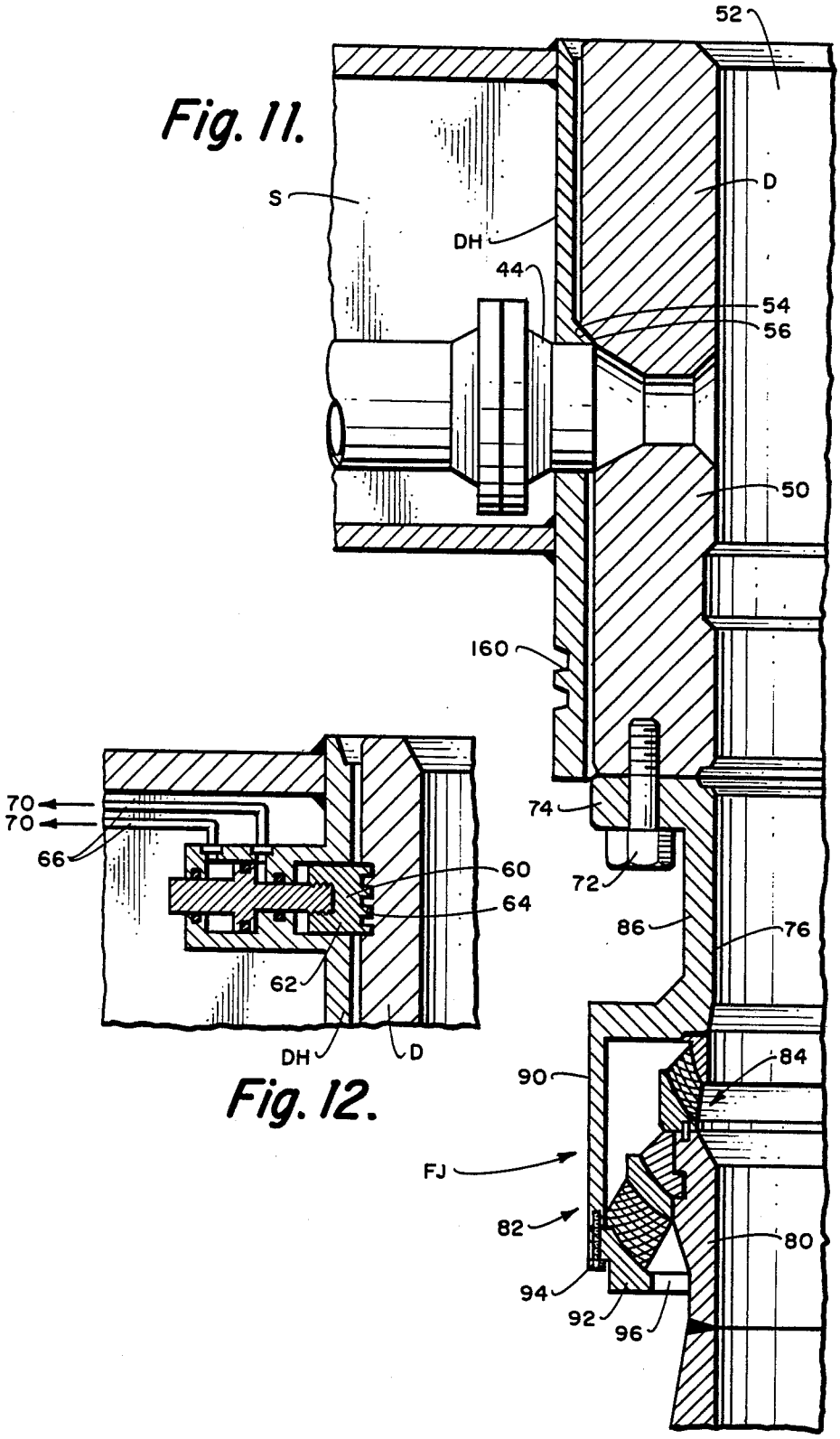
FIG. 11 is an elevational cross-sectional view of part of the diverter, housing and flexible joint taken along line 11—11 of FIG. 4.
FIG. 12 is an elevational cross-sectional view of a diverter lock down dog, taken along line 12—12 of FIG. 4.
Figure 19:
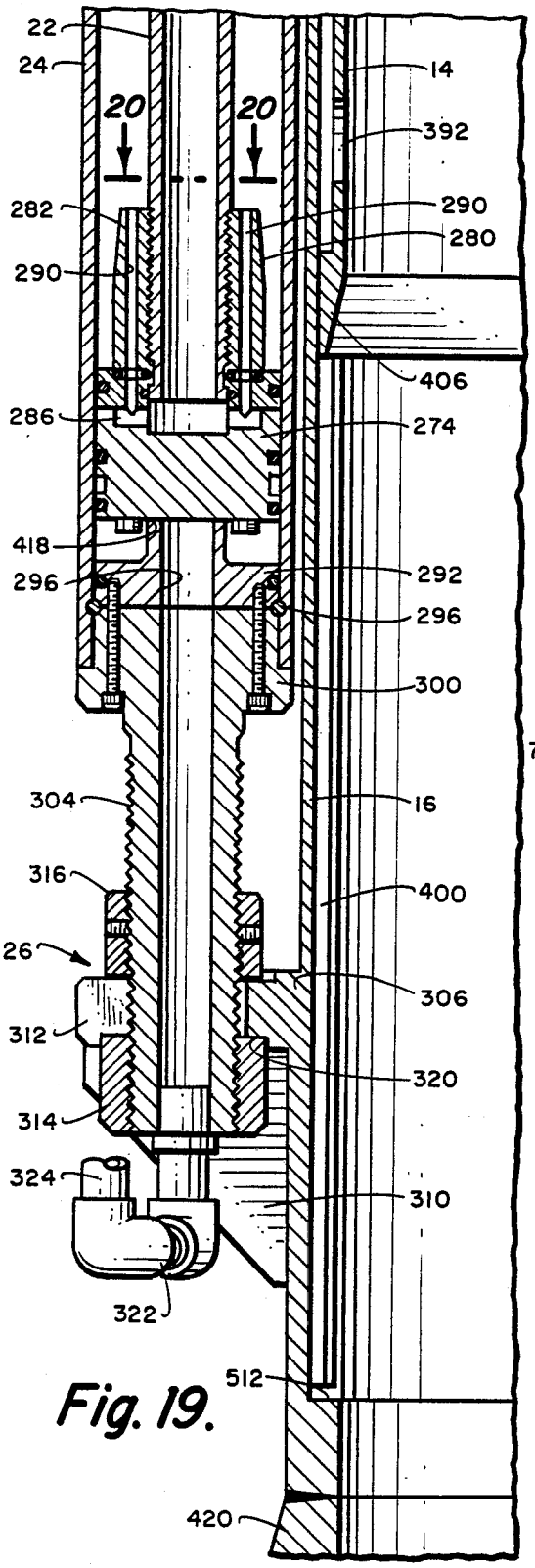
FIG. 19 is an elevational cross-sectional view of the lower part of the cylinder assemblies attached to the outer barrel, taken along line 19—19 of FIG. 8.

To facilitate understanding of the upper marine riser package 10, which will be described in detail hereinafter, FIGS. 2, 4 and 11 show the rig sub-structure or supporting structure S of diverter housing DH, attached thereto as by a fixture F, containing the diverter D to which is connected a flexible joint FJ (FIG. 11). The flexible joint FJ supports an upper spool 12 (FIGS. 13 and 14) which, in turn, supports: first, a fixed inner barrel 14 (the first part of the slip joint SJ), and second, a moveable outer barrel 16 telescoped over the inner barrel (the second part of the slip joint SJ), by multiple peripheral tensioning cylinder assemblies 20 (FIGS. 2 and 13–19). These tensioning cylinder assemblies 20 (presently eight in number although the number can vary), have their respective hollow piston rods 22 connected to the upper spool 12 while the respective outer cylinders 24 are connected to the moveable outer barrel 16 by connecting assembly 26 (FIG. 19). Double packer seal assemblies 30 (FIGS. 13 and 14) provide an annular seal between the inner barrel and outer barrel and, since the barrels are keyed together by slot and key assembly 32 (FIGS. 14 and 18), rotational torque is transmitted from the inner barrel to the outer barrel through riser rotation bearing joint RB to the riser when the vessel is used to orient the lower stack before landing on wellhead. The riser rotation bearing RB joint is equipped with locking/unlocking devices and a gear system assembly 36, which are used to orient the lower riser stack if the vessel is required to maintain the heading to the current or wind during a storm (FIGS. 2, 9, 22 and 23).

Figure 15:
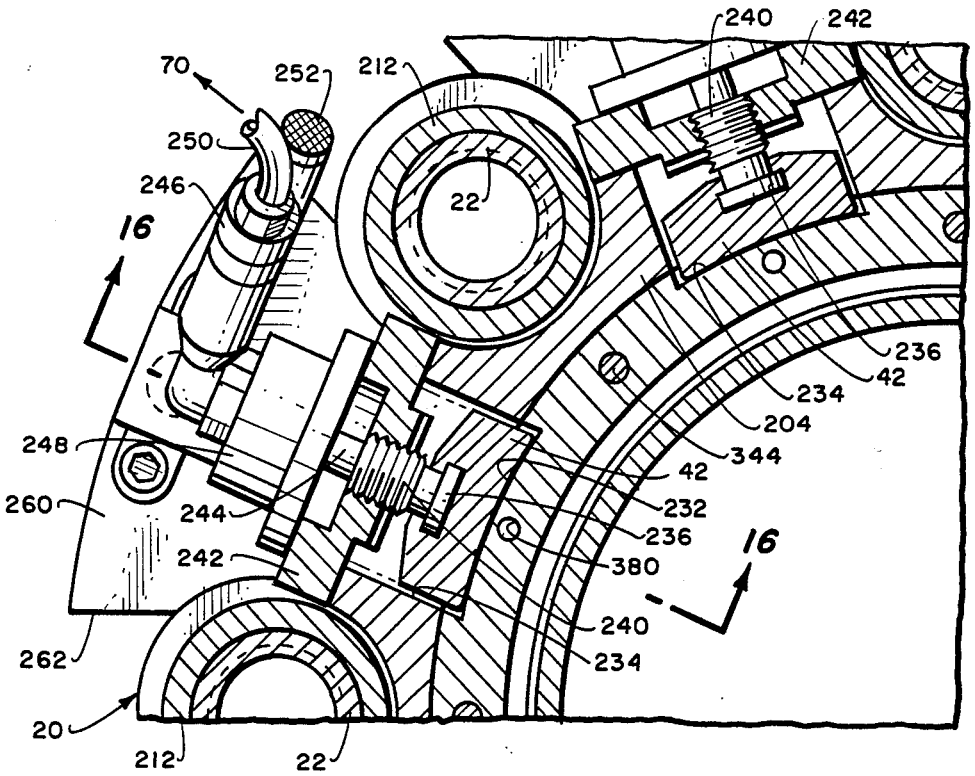
FIG. 15 is a cross-sectional view of some of the lock-up dogs, taken along line 15—15 of FIG. 14.
Figure 17:
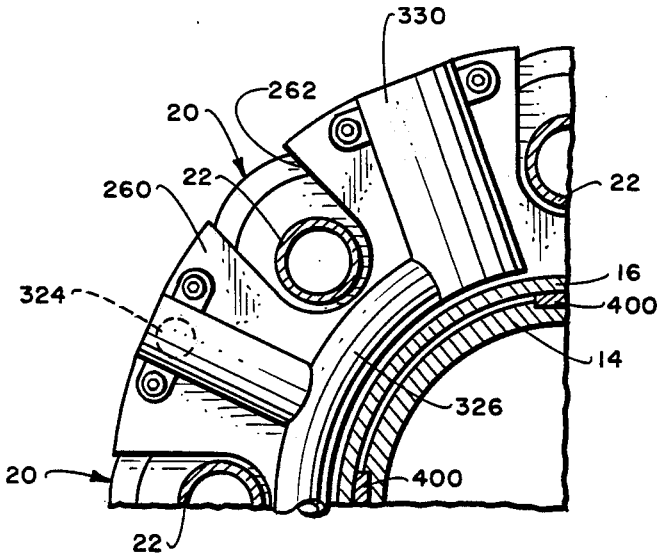
FIG. 17 is a view of the air manifold, taken along line 17—17 of FIG. 14.
Figure 16:
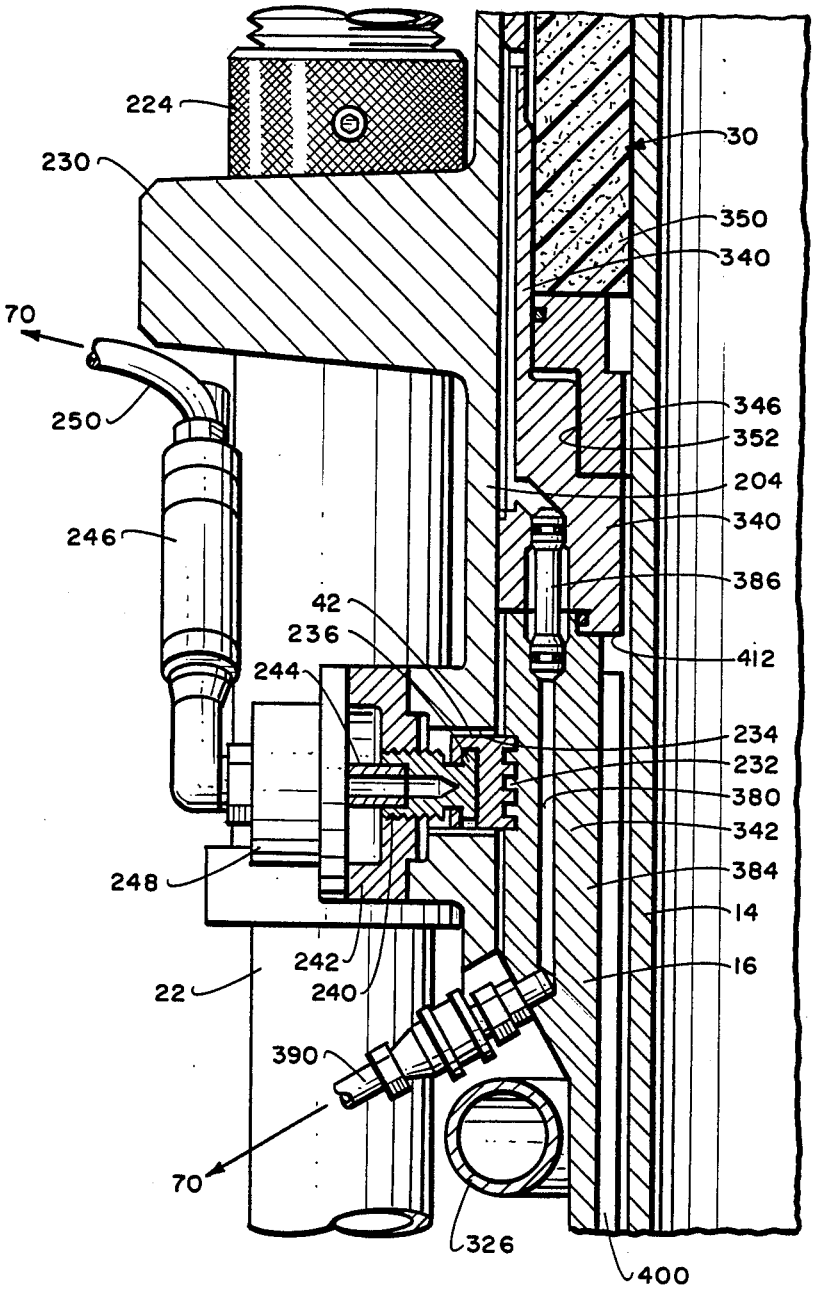
FIG. 16 is an elevational cross-sectional view of one of the lock-up dogs, taken along line 16—16 of FIG. 15.

The upper marine riser package 10 is shown connected to the upper riser of riser string RS by a riser connector RC (FIGS. 2 and 22) and the slip joint SJ is held in fully retracted position, as shown in the drawings, by a plurality of outer lock-up dogs 42 located below the upper spool (FIGS. 15 and 16).

Now in more detail (FIGS. 4, 11 and 12), the housing DH is cylindrical, fixed to and extends downwardly through the rig sub-structure S, and is typically provided vents 44 and mud-flow outlets 46. The housing is attached to beams of the rig substructure slightly below the rotary table and houses the diverter D. The diverter D is typically a cylindrical ring 50 with an inner bore 52 with the operating apparatus therein. Only the ring 50 and bore are shown since the inner apparatus and its function is conventional. The outer wall of the cylindrical ring 50 is provided with a landing shoulder 54 which engages a radially inwardly extending landing edge 56, sometimes referred to as a landing profile, on the inner surface of the housing to limit the downward movement of the diverter D. This profile supports the entire package, risers, connectors, etc., during operation. A plurality of hydraulically actuated diverter lock-down dogs 60 are located around the outer periphery of the housing, extend through windows 62, and engage a plurality of locking grooves 64 formed on the outer wall of the diverter D to lock the diverter D within the housing DH. All hydraulically actuated lock-down dogs are identical and the cylinders thereof are connected by a pair of hydraulic lines 66 for extension and retraction of the lock-down dogs to an operator controlled pressure system 70 located on the rig and shown schematically as block diagrams in FIG. 3. Similarly connected hydraulically actuated lock dogs are shown in the U.S. Pat. No. 4,057,267 of Jones to which reference is made.

The function and operation of the diverter D is conventional. It is activated to vent uncontrolled formation gas out a line connected to the vent 44. This connection may also be used as a flushing line. Return mud flows out a line connected to outlet 46.

Attached to the lower end of the diverter D is a flexible joint FJ. To do this, the lower surface of the diverter D is provided with a plurality of threaded bores to receive the threaded ends of suitable bolts 72 (one shown) extending through a radially extending attaching flange 74 forming part of the flexible joint FJ.

The flexible joint FJ comprises two main body members, an upper body member 76 and a lower body member 80 which is telescoped within the upper body member 76 and separated therefrom to accommodate an elastomeric bearing assembly 82 and an elastomeric seal assembly 84.

The upper body member 76 is provided with an axial bore, the diameter of which is substantially coextensive with the inner bore of the diverter D and is provided with a radially narrow neck 86 immediately below the flange 74 to accommodate the heads of the bolts 72 attaching the flange 74 to the diverter D. The upper body member is also provided with a cylindrical downwardly opening housing 90 with its inner wall spaced from the lower body member 80 and encloses the bearing assembly 82 and seal assembly 84. The outer diameter of the outer wall of the housing 90 is substantially the same as the outer diameter of the flange 74, and has an outer bearing ring 92 suitably attached to its lower end as by a plurality of threaded bolts 94. The radially inner edge 96 of the bearing ring 92 is spaced from the lower body member 80 to provide a clearance for tilting movement of the lower body member relative to the upper body member 76. The bearing assembly 82, which includes the bearing ring 92 and the manner of operatively connecting the bearing assembly to the two main body members 76 and 80, are fully taught in the U.S. Pat. No. 4,068,868, supra, to which reference is made for more complete information concerning this bearing assembly 82. The sole difference between the bearing assembly of this invention and that discussed in the Patent is in the increased amount of loading on the bearing assembly in this invention. However, it is within the skill of those in the art to select the size, shape and type of materials to accommodate this increased load using the teaching of the Patent. See also the use of an elastomeric bearing in the U.S. Pat. No. 4,391,554 to Jones to which reference is made.

Also located on the upper end of the lower body member 80 is the aforementioned seal assembly 84 to prevent leakage from the interior of the flexible joint into the cavity within the housing 90. This seal assembly 84 permits relative flexing or tilting in all directions while maintaining the integrity of the seal. Again, reference is made to the U.S. Pat. No. 4,068,868, supra, which discusses a similar seal assembly and the manner of operatively connecting the seal to the two main body members 76 and 80, in detail.

The lower body member 80 (shown in two pieces welded together in FIG. 11) extends downwardly beyond the cylindrical housing 90 and terminates in a lower radially outwardly extending flange 100 (FIG. 13) which is bored and affixed by suitable bolt assemblies 102 to a flange 104 comprising the upper end of the upper spool 12.

The upper spool 12 is part of the self-tensioning slip joint SJ supporting the inner and outer barrels and tensioning cylinders, the bearing joint RB and the connected risers.

The upper spool 12 is a relatively long, relatively thick cylindrical ring, with an outer diameter substantially equal to the diameter of the diverter D. The outer periphery of the ring is configured to form the aforementioned flange 104 and to also provide a spider landing shoulder 106 to aid in making up the package. This make up procedure will be discussed in more detail later.

The inner bore of the spool is provided with a counterbore 110 which provides space for a landing ring 112 (inner barrel hanger). This landing ring 112 is locked into the inner barrel by a split ring 114 trapped in oppositely facing grooves on the ring and upper end of the inner barrel 14 and also contains a plurality of screws 116 (only one being shown) which engage threaded holes in the landing ring 112 and screwed to engage the mating slots in the upper end of the inner barrel 14, thus preventing the inner barrel from rotation or, as designed, making the inner barrel to rotate with the rig. The radially outer periphery of the landing ring is locked to the upper spool 12 by a key/slot and landing arrangement 120 and thus is keyed to the inner barrel. An insert piece 122 lands on the top of the inner barrel to provide an inner diameter approximately coextensive with the inner diameter of the inner barrel and bore of the flexible joint FJ. This insert extends upwardly into the bore of the lower body member 80 of the flexible joint and straddles the joint between the flange 100 and the flange 104 to provide a sealed bore. The insert 122 is held against movement by a split ring 124 disposed within oppositely facing grooves in the flange 100 and insert 122 and is locked in place by a second split locking wedge 126 and a resilient O-ring 130 disposed in the same groove in the insert. The O-ring pressures the locking wedge 126 upwardly behind the split ring 124, to retain the same position, but permits easy removal by withdrawal of the resilient O-ring 130. The lower end of the insert 122 has a shoulder 132 which engages the top edge of the inner barrel, and thus serves to restrain the inner barrel and lock ring 112 from upward movement. Suitable sealing means, such as O-ring seals, are provided to prevent leakage out between the flanges and elsewhere.

Figure 13:
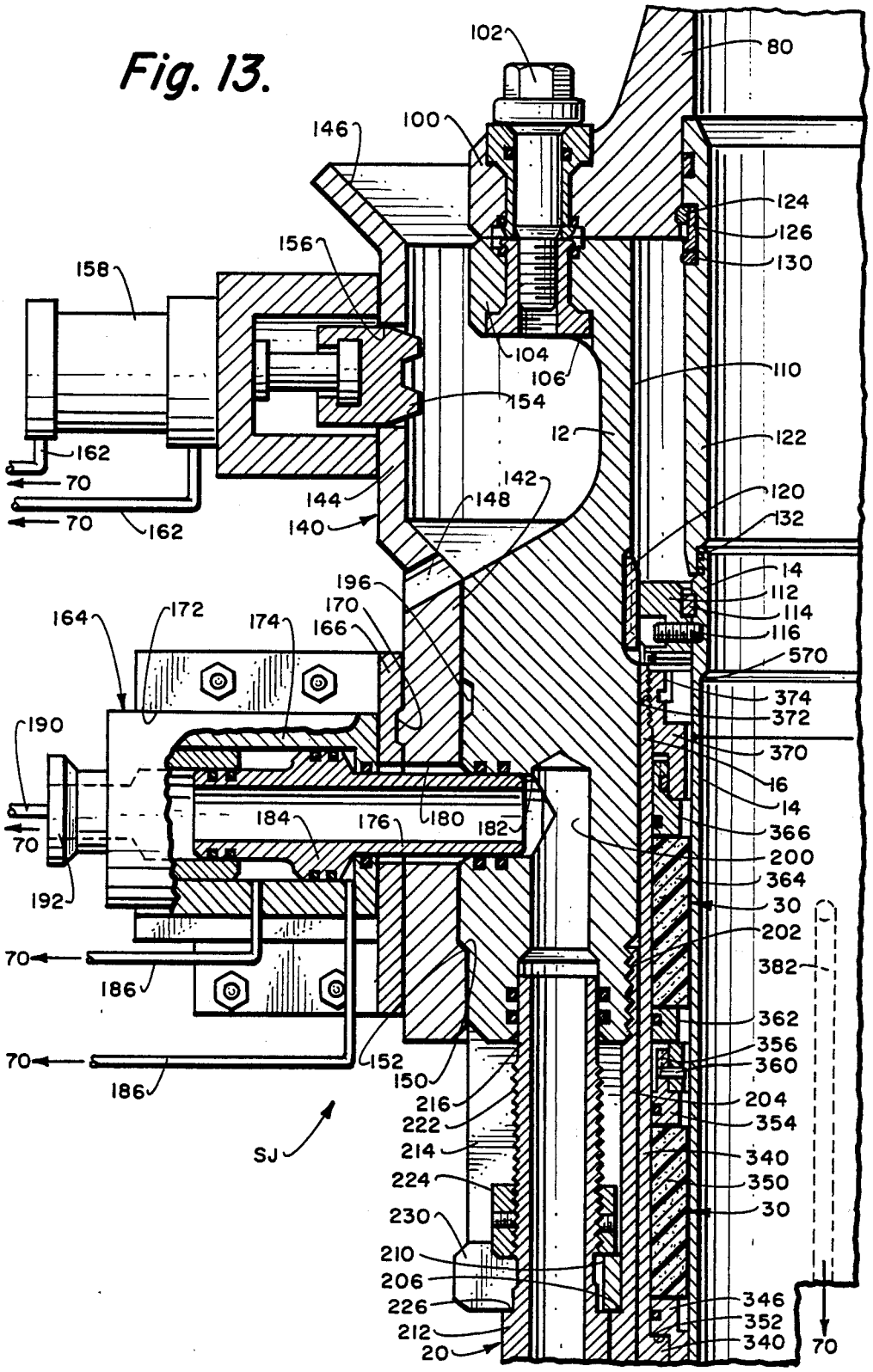
FIG. 13 is an elevational cross-sectional view of the lower flange of the flexible joint, carrier, packer seal assemblies, etc. taken along line 13—13 of FIG. 5.

Surrounding the upper spool 12 is a cylindrical carrier 140 comprising a wall which extends from approximately the lower end of the upper spool 12 to approximately the upper end of the upper spool 12. Approximately the lower half portion 142 of the carrier is thicker than the remainder of the ring and is a sliding fit with the outer surface of the upper spool. The mid portion 144 of the carrier has a larger radial inner diameter than that of the lower portion and extends upwardly to terminate in a upwardly facing funnel 146. The mid portion 144 joins the lower end of the diverter housing DH and the funnel 146 aids in guiding the carrier around the diverter housing DH. A drain passage 148 is located between the lower and mid portions of the carrier. This carrier 140 has thus two positions—a stored position attached to the diverter housing DH, and an operating position surrounding the upper spool. The two positions of this carrier are part of the makeup procedure of the package which will be described later. The lower end of the carrier 140 also has an inner landing profile 150 which is engaged by a radial shoulder 152 on the upper spool 12 when the upper spool is landed within the carrier as shown in FIG. 13.

In the mid portion 144 of the carrier 140, a plurality of hydraulically actuated locking dogs 154 are located circumferentially of the ring. These dogs are used to attach the carrier to the diverter housing. Since all the locking dogs and their hydraulic actuating are identical, only one will be described. Thus, each locking dog moves in and out through a window 156 in the carrier to engage and disengage mating grooves 160 (FIGS. 2 and 11) in the outer periphery of the housing DH and the cylinder 158 is connected by a pair of lines 162 to the same operator controlled system 70 located on the rig. Thus, these locking dogs are similar in function and operation to the previously described locking dogs 60.

At the lower portion 142 of the carrier, there is provided a plurality of hose/stab assemblies 164 positioned on a clamping ring 166. The clamping ring 166 is formed in halves and bolted together to clamp around the outer periphery of the carrier 140 and is positioned thereon by a circular key and slot arrangement 170. The clamping ring is provided with radially outwardly extending cavities 172, also formed in two halves bolted together and welded to the clamping ring to engage the outer periphery of the housing 174 of the hose/stab assemblies 164.

Since all the hose/stab assemblies are identical, only one will be described. Thus, each hose/stab assembly 164 has a hollow stab (tubing) 176 moveable radially inwardly and outwardly through windows 180 in the clamping ring 166 and carrier 140, respectively, and into and out of a suitable horizontal port 182 in the upper spool 12. Windows 180 are larger than the outer diameter of the stabs 176 to allow the stabs to "float" to compensate for tolerance variations in the carrier, clamping ring and the port 182. The O-rings, positioned in the port, sea against the stab to prevent leakage from the port 182. The stab is a hollow rod integral to a piston 184 reciprocable in a chamber in response to hydraulic fluid entering the chamber on either side of the piston from a pair of hydraulic lines 186 connected to a chamber and to a source of fluid under pressure. The chamber is also connected to hydraulic fluid under pressure through a line 190 connected to a coupling 192 located on the end of the housing. This latter fluid under pressure enters the chamber, passes through the piston via the hollow tube and into the port 182 of the upper spool 12. So that the piston will not be responsive to this latter fluid pressure, the piston is hydraulically balanced and is thus responsive only to the fluid in the two lines 186 for movement of the stab in and out of the upper spool. The source of hydraulic fluid under pressure for lines 186 and 190 is the same operator controlled pressure system 70, supra.

The mid portion 144 of the carrier 140 is also provided with a plurality of hydraulically actuated locking dogs 194 (FIGS. 2 and 6) interspersed between the hose/stab assemblies (four of such locking dogs being shown, although their number could vary) to engage a suitable groove 196 (FIG. 13) in the upper spool 12 to lock the carrier onto the upper spool when the carrier is released from the diverter housing, so that the dynamic load of the carrier is not imposed on the hydraulic stabs 176.

The hydraulic apparatus for actuating these locking dogs 194 is the same as the previously described locking dogs and is connected by a pair of hydraulic lines 198 to the operator controlled pressure system 70. Therefore, no further description is deemed necessary.

Thus, it should be apparent that the locking dogs 154 located on the mid portion of the rig are used to lock the carrier onto the diverter housing DH before and when the upper spool lands in the carrier. Once the upper spool has landed in the carrier with proper orientation, the four locking dogs 194 on the lower portion of the carrier are activated to lock the carrier onto the upper spool. Then, the hollow stabs 176 are pressured to stab into their corresponding ports. The next step is to retract the upper locking dogs 154 from the diverter housing DH allowing the carrier and hose/stab assemblies to lower with the upper spool until the diverter itself has landed on the diverter landing profile 56. This is the position of the upper spool as shown in FIG. 13.

Also as shown in FIG. 13, the horizontal ports 182 on the upper spool 12 and their stabs 176 communicate with vertical ports 200 on the upper spool 12 which in turn are connected to the hollow piston rods 22 of the tensioning cylinder assemblies 20 forming part of the self-tensioning slip joint SJ. These tensioning cylinder assemblies 20 and how they are attached and operate in the package will now be described. It is understood, of course, that the length of the cylinder assemblies is commensurate with the amount of vertical movement due to the heave of the vessel during operation.

The lower end of the inner bore of the upper spool 12 is counterbored and threaded as at 202 to receive an externally threaded inner sleeve 204, which has an inner diameter coextensive with the inner diameter of the upper spool and which telescopes over the outer diameter of the outer barrel 16 to accommodate the outer barrel 16. This sleeve 204 is provided with an upwardly facing ledge 206 formed by reducing the outer wall of the sleeve. A stab sub supporting plate 210 (FIGS. 7 and 13) seats on this ledge and supports cylindrical hollow stab subs 212 (eight in number although their number may vary), as well as the hollow piston rod 22 coupled thereto. The sleeve 204, the stab sub support plate 210 and the supporting ribs 214 are an assembled part which is subsequently welded to the low end of the upper spool to form a rigid support for the cylinder assemblies. Since all stab subs are identical, only one will be described. Thus, the stab sub 212 has a smooth outer surface at its top end 216 and is insertable in the vertical port 200 (one shown in FIG. 13). Suitable O-ring seals are positioned in the port 200 to form a liquid tight connection. The stab sub 212 is internally threaded at its lower end, as at 220 (FIG. 14), to engage mating external threads on the upper end of the hollow piston rod 22. The stab sub is also provided with external threads 222 at its mid portion on which a clamping nut 224 is threaded. The clamping nut 224 engages the upper surface of the stab sub supporting plate 210 and, together with a stop (ledge) 226 on the stab sub, hold the stab subs in place after having been inserted into the vertical bore 200 in the upper spool 12. The stab sub supporting ring 210 has a radially opening groove 230 (FIG. 7) to allow the stab subs to be inserted and removed from the stab sub support plate 210. The lower end of the tensioning cylinder assemblies 20 are removeable at the connection assembly 26 also for this purpose. Thus, when the clamping nut 224 is backed off out of engagement with the stab sub supporting plate 210, the stab sub/hollow piston rod 22 can be lowered to allow removal of the stab sub from the upper spool, and the stab sub, together with the cylinder assemblies 20, can be pulled outwardly for removal and repair. Making up the connection of the cylinder assembly 20 and stab sub is a reverse procedure. The disconnection of the cylinder assembly 20 from the connecting assembly 26 will be described later.

The outer barrel lock-up dogs 42 (eight used, but their number can vary) are spaced peripherally between the stab subs and located below the stab supporting plate 210. Their purpose is to hold the outer barrel in position until the cylinder assemblies 20 are pressurized. Since all eight lock-up dogs 42 are identical, only one will be described (FIGS. 15 and 16). Thus, each dog 42 is moveable radially in and out of engagement with a plurality of grooves 232 formed in the outer barrel through a window 234 in the sleeve 204. Each dog 42 is coupled by a retainer head and groove assembly 236 to an actuating screw 240 threaded for rotation within a threaded bore in a support plate 242 fixed to the sleeve 204. The screw is rotated by a shaft 244 by an air motor 246 driving a gear box 248 to move the dog 42 radially in and out of engagement with grooves 232. The air motor/gear reducer combination is suitably fixed to the support plate 242 and air under pressure is supplied to the motor via air supply line 250 connected to the operator controlled pressure system 70 on the rig. Exhaust 252 is part of the motor.

Below the lock up dogs 42 is a stabilizing ring 260 clamped to the outer barrel 16 to hold (centralize) the cylinder assemblies 20 relative to the outer barrel. This stabilizing ring 260 is formed in halves with radial flanges (not shown) bolted together and is provided with radially opening slots 262 to allow the cylinder assemblies 20 to be removed for repair and replacement. The stabilizing ring 260 is similar to the stab sub supporting plate 210 of FIG. 7 and thus is not shown in plan view and, again, since all eight cylinder assemblies 20 are identical, only one will be described.

Figure 20:
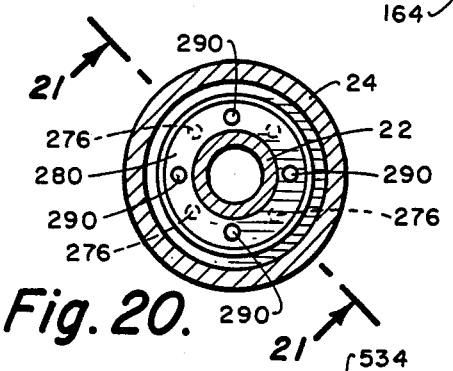
FIG. 20 is a plan view of the snubber located at the lower end of the cylinder assemblies, taken along line 20—20 of FIG. 19.
Figure 21:
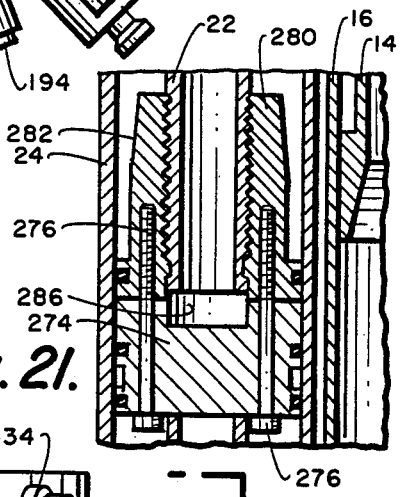
FIG. 21 is an elevational cross-sectional view of the snubber, taken along line 21—21 of FIG. 20.
Figure 28:
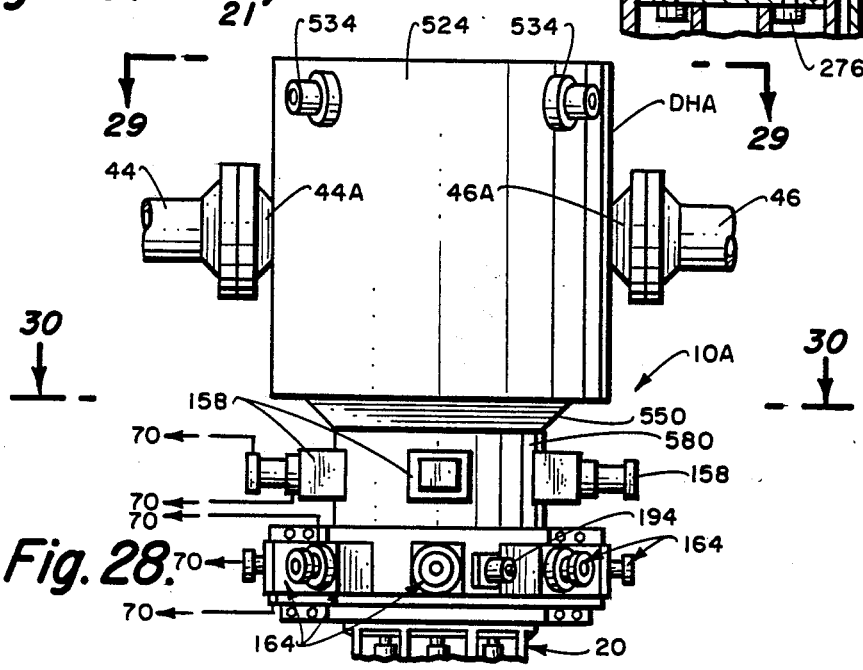
FIG. 28 is an elevational view of the upper portion of the second embodiment of this invention.
Figure 7:
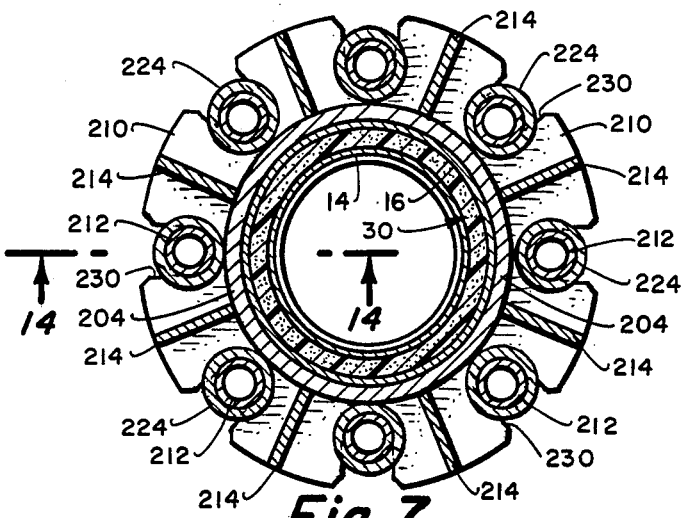
FIG. 7 is a cross-sectional view showing the connection of the stab subs to a retainer plate, taken along line 7—7 of FIG. 2.
Figure 8:
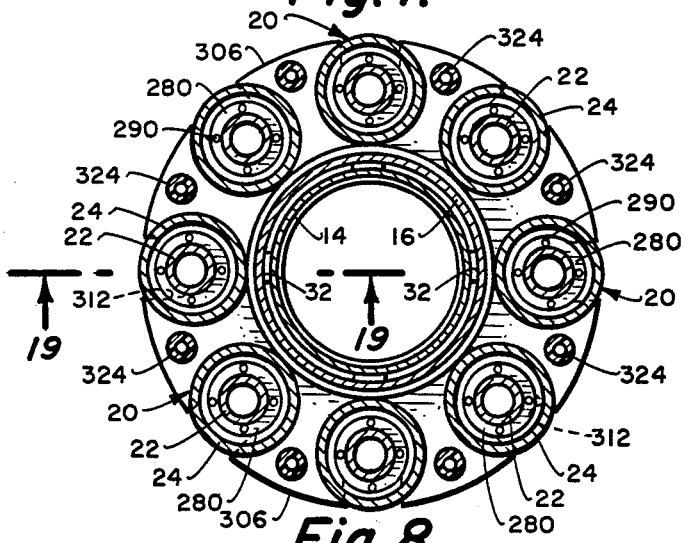
FIG. 8 is a cross-sectional view showing the cylinder assemblies and connector assembly for the lower end of the cylinder assemblies, taken along line 8—8 of FIG. 2.
Figure 9:
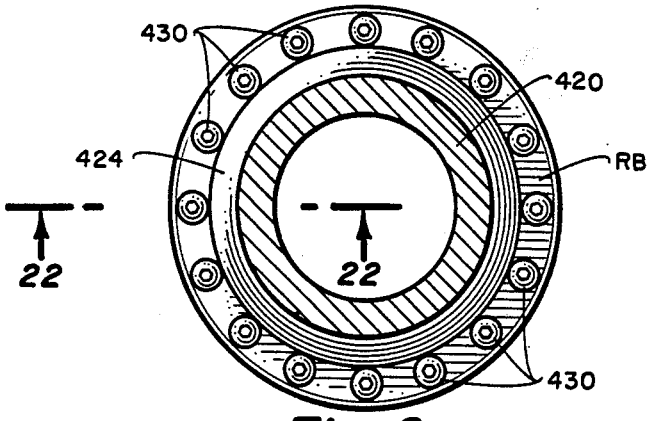
FIG. 9 is a cross-sectional view showing the top and bore of the rotation bearing joint, taken along line 9—9 of FIG. 2.

As shown in FIG. 14, each outer cylinder 24 of each cylinder assembly 20 is closed at its upper end by a centrally apertured cylinder head 264 inserted within the cylinder 24 and held in place by the combination of a positioning ring 266 and a bushing 270, which engages a shoulder on the cylinder head and which is fixed thereto by set screws 272. Both the inner wall of the cylinder, the cylinder head, and the bushing have semicircular grooves to collectively receive the positioning ring 266. A plurality of resilient seals in the aperture of the cylinder sealingly engage the piston rod and allow axial movement therein. As shown in FIGS. 19–21, a slideable piston 274 is fixed to the lower end of the piston rod 22 and provided with resilient seals which sealingly engage the inner wall of the cylinder in a conventional manner. Suitably attached to the top of the piston, as by bolts 276 is a snubber 280. This snubber 280 is a barrel-like member, having a conically formed outer surface 282 which will be received in the downwardly facing hollow cup-like area 284 of the cylinder head 264. The snubber and cup-like area will cushion the fall of the cylinder head if the cylinder assemblies were to lose hydraulic pressure at any time. The piston is also provided with radial passages 286 which communicate with vertical passages 290 in the snubber. Fluid from the operator controlled pressure system 70 communicated through the upper spool, through the hollow piston rod and through passages 286 and 290 which open into the upper chamber formed by the piston, cylinder wall and cylinder head.

The lower end of the cylinder assembly is closed in a manner similar to the manner in which the cylinder head is attached, that is, ring 292, having a central aperture 294, is inserted in the cylinder, is held against a positioning ring 296 by an internally threaded extension sub or cap 300 which is bolted to the ring 292 and has a ledge 418 which engages the end of the cylinder. Suitable grooves in the ring 292, the extension sub 300, and the cylinder wall hold the positioning ring in place. The extension sub 300 has a reduced portion which is externally threaded as at 304 and is long enough to extend beyond support plate 306, formed as an integral part of the outer barrel as a forged ring welded to the outer barrel. This forged ring is part of the previously mentioned connecting assembly 26 and is braced for strength by a plurality of strengthening ribs 310. The plate 306 is provided with radially outwardly open slots 312 (FIG. 8) to allow insertion and threaded extension sub 300. A retainer head 314 beneath the plate 306 cooperates with a nut 316 which is rotated downward to fasten the extension sub 300 to the support plate. The retainer head 314 seats in the counterbore 320 in the lower face of the support plate, thus securing itself and the extension sub on the plate.

To remove the cylinder assembly, the nut 316 is threaded upwardly and then, the nut 224 on the stab sub 212 at the upper end of the assembly is also threaded upwardly allowing the stab sub to drop clear of the port so that the assembly can be maneuvered out through the slots of the upper and lower support plates.

Both the ring 292 and the extension sub 300 are internally axially bored and connected to a pair of L-couplings 322 which are connected to a hose 324 which extends upwardly between adjacent cylinder assemblies 20. The upper end of the hose 324 (FIGS. 2, 16 and 17) is connected to a hollow ring manifold 326 located about the cylinder assemblies and below the lock-up dogs 42. This manifold surrounds the outer barrel and is connected in any suitable manner as by bolting to the stabilizing ring 260. The manifold also has large exhaust lines 330 connected by hoses to the rig. Thus, air trapped in the chamber of the cylinder 24 below the piston 274 is vented to the manifold and to the surface via the bores in the ring 292 and extension sub 300 and out through the hoses 324. Air in the manifold is vented to the surface via the exhaust lines 330.

Referring again to FIGS. 13, 14 and 16, when the outer barrel is in lock-up position, as shown, the double packer seal assemblies 30, providing the annular seal between the inner and outer barrels, are located in the same vertical position as the upper spool and its extension. On top of the outer barrel 16 is a hollow, cylindrical packer gland 340 which houses the double packer seal asemblies 30. The packer gland 340 is attached to a radial flange 342 on the top end of the outer barrel by bolts 344 (FIG. 14). A stepped bearing ring 346 on the lower end of the lower packer seal 350 lands on a stepped ledge 352 formed on the packer gland. The upper end of the lower packer seal 350 is provided with a second bearing ring 354 having a plurality of J-slots 356 (with only the vertical groove of only one J-slot being shown) to receive a pin 360 on still another bearing ring 362 which partly extends into the bearing ring 354. The pin in the J-slot 356 locks the two rings together during installation and also against relative rotation, but allows the two rings to be separated if necessary. The bearing ring 362 belongs to the upper packer seal 364. Attached to the upper end of the upper packer seal 364 is a fourth bearing ring 366, identical to the bearing ring 354. A lockdown ring 370 has external threads 372 to engage internal threads on the upper end of the packer gland and has a plurality of J-slots 374 (again, only one being shown) by which a running tool can rotate this lockdown ring 370, and thread the lockdown ring into the outer barrel to hold the double packer seal assembly in place and to force expansion of both upper and lower packer elements. This same running tool can be used to retrieve replacement since all J-slots are identical.

Either one of the double packer seals can be pressured from behind against the inner barrel by air under pressure from a suitable source. In this embodiment, and as shown in FIGS. 13 and 16, the packer gland is provided with two passages 380 and 382 extending from below lock-up dogs 42 to the packer seals. Passage 380 extends to the middle of the lower packer element 342 and the other passage 382 extends to the middle of the upper packer element 354. Both passages extend through an enlarged radius 384 on the outer barrel and through the packer gland 340 (passage 380 more clearly shown in FIG. 16) via a crossover tube 386, and are connected by air lines through hoses 390 to the rig where there are attached to a source of air pressure, such as an accumulator or to the operator controlled pressure system 70. Drilling fluid will enter the space between the inner and outer barrels, by reason of apertures 392 (FIG. 19) in the inner barrel 16 during operation, thus helping to lubricate the packing elements.

As previously mentioned, the outer and inner barrel are keyed together by key assembly 32. The key assembly comprises an elongated keys 400 on the outer barrel 16 and which extend the full length of the stroke of the slip joint and are attached to the outer barrel by plug wells 402 (FIGS. 14, 16 and 18). These keys 400 slide within key slot 404 formed in the inner barrel shoe 406 (FIG. 19) and also in a reaction ring 410 (FIGS. 14 and 18). The reaction ring on inner barrel also serves as a stopper for the slip joint when it comes in contact with the lower ledge 412 (FIG. 16) of the packer gland. Since the two barrels are keyed together, the aforementioned riser rotation bearing joint RB is appropriate to transmit torque from the outer barrel to the inner barrel due to rig rotation. This riser rotation bearing joint RB will now be described.

Figure 22:
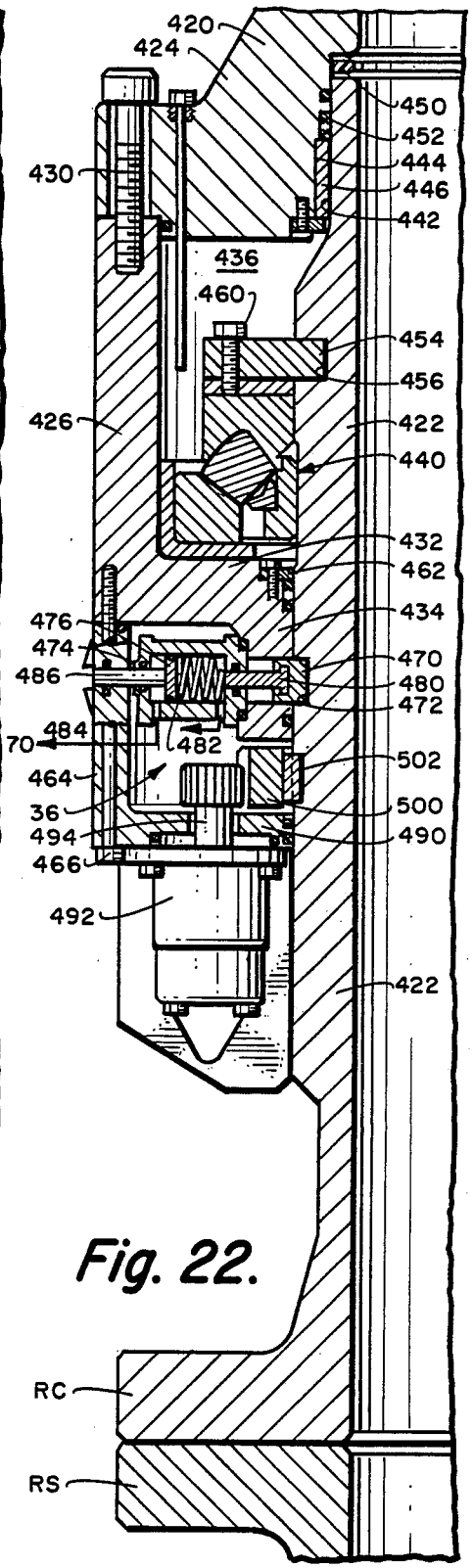
FIG. 22 is an elevational cross-sectional view of the rotation bearing joint, locking and unlocking devices, and gear system taken along line 22—22 of FIG. 9.

As shown in FIGS. 19 and 22, the riser rotation bearing RB comprises two telescoped tubular body members 420 and 422. The upper tubular body member 420 has a reduced portion which is welded to the outer barrel 16 and which terminates in a radial flange 424. An outer cup-like housing 426 is attached by bolts 430 (one shown) to the bottom of the flange. The outer wall of the housing 426 is spaced from the lower tubular body member 422 and terminates in a radially inwardly extending wall 432 and a barrel extension 434 which engages the outer lower body member in rotatable relationship. Wall 426 defines an oil filled cavity 436 which houses a spherical roller thrust bearing assembly 440. The upper end portion of the lower tubular body member is reduced as at 442 and is telescoped within a counterbore 444 in the upper tubular body member 420. A suitable low friction ring bearing 446, a thrust spacer or cushion ring 450, and suitable seals 452 provide free fluid tight rotation between the two tubular body members. Below the reduced upper end portion 442, the lower tubular body member is provided with a split ring 454 located in a circumferential groove 456 in the lower tubular body member and bolted as at 460 to the top race of the bearing assembly. The split ring 454 and bolt 460 retain the spherical roller bearings, bearing races, etc., of the spherical roller thrust bearing assembly 440 in place to operatively function, as such, between the upper and lower tubular body members. Suitable rotary seals 462 between the barrel 434 and lower tubular body member provide a fluid tight relationship between the housing and lower tubular body member.

The assembly comprising the locking/unlocking devices and gear system 36 are located below the riser rotation bearing joint RB and is used to orient the lower riser stack if the vessel is required to maintain heading to the current or wind during a storm.

Figure 10:
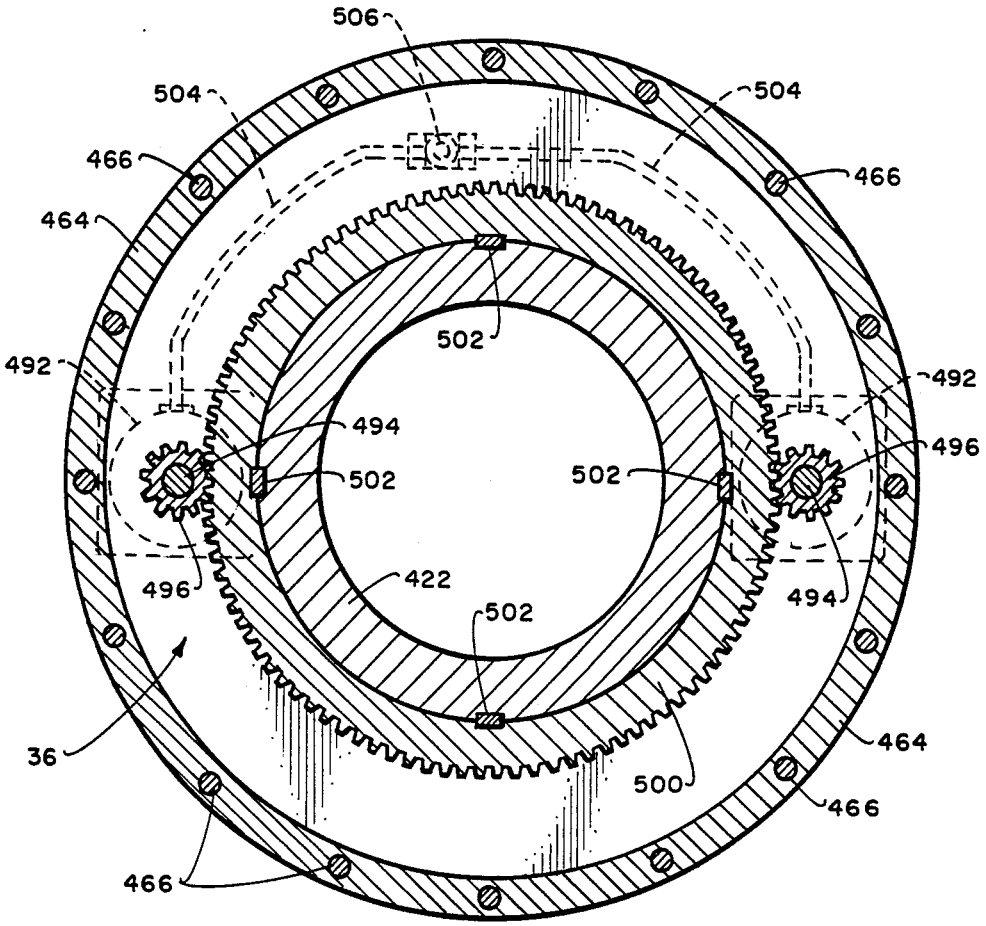
FIG. 10 is a cross-sectional view showing the gear system of the rotation bearing joint, taken along line 10—10 of FIG. 2.
Figure 23:
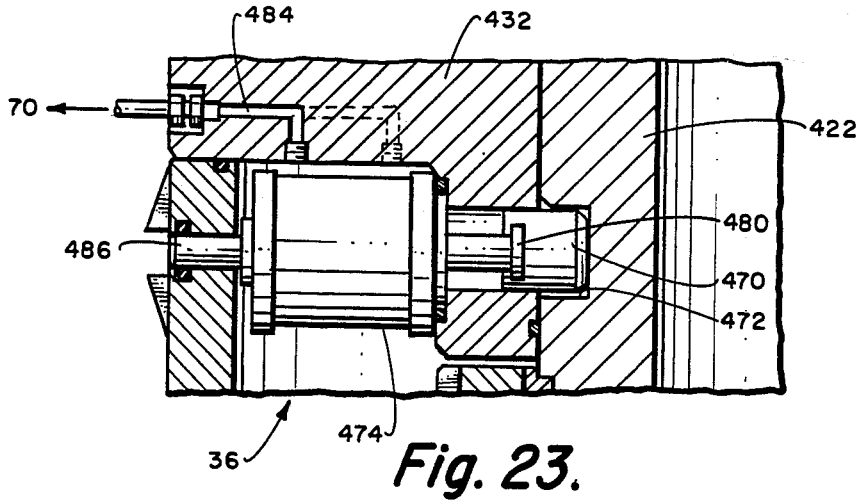
FIG. 23 is an elevational cross-sectional view of one locking/unlocking device shown in FIG. 22, FIGS. 24–27 illustrate the steps in landing the upper marine riser package onto the hose/stab carrier first and then finally in the diverter housing.

As shown in FIG. 22, a second outer housing 464 whose outer wall is coextensive with the outer wall of the housing 424 of the bearing joint, is attached to the housing 426 by bolts 466. This housing encloses the loading/unloading devices and part of the gear system. Since there are a plurality of these devices located circumferentially of the lower tubular body member, only one is described and shown. Thus, in FIGS. 22 and 23 it can be seen to comprise a locking pin 470 moved into and out of engagement within a suitable bore 472 in the lower tubular body member by a hydraulic cylinder 474. Its piston 476, connected to the pin 470 by a retainer head and groove arrangement 480, is biased by a spring 482 outwardly from the bore 472. The cylinder is hydraulically connected by a suitable hydraulic line 484 to the operator controlled pressure system 70 on the rig. Thus, the spring 482 urges the locking pin 470 out of engagement with the bore 472 and the hydraulic pressure is used to urge the lock pin into the bore. A pin 486 signals the position of the locking pin 470. Attached to the lower radially inward wall 490 of the housing below the locking/unlocking devices is the gear system of assembly 36 which comprises a pair of hydraulic motors 492 (FIGS. 10 and 22). Each motor shaft 494 drives a pinion gear 496 which meshes with a ring gear 500 fixedly attached to the lower tubular body member 422 by drive keys 502 so that rotation of the motor shafts rotate the tubular member 422 relative to the upper tubular body member 420 when the lock pins 470 are withdrawn from the tubular body member. Each motor is hydraulically connected by branch lines 504 to a main line 506 to connect the operator controlled pressure system 70. Rotation of the lower tubular body member is incremental depending on the circumferential spacing of the locking bores 472.

Figure 24:
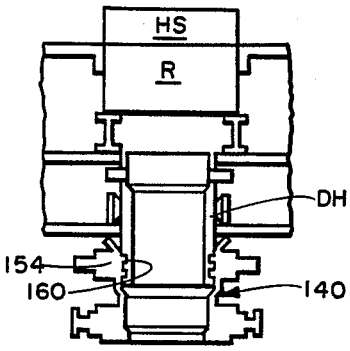
Figure 25:
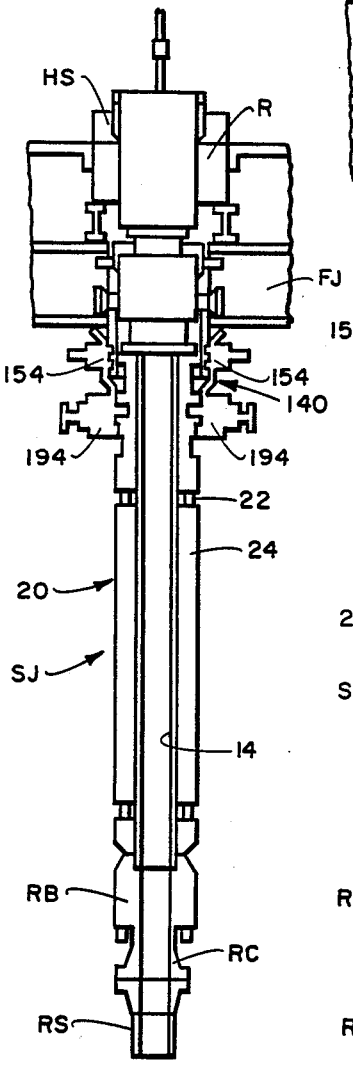
Figure 26:
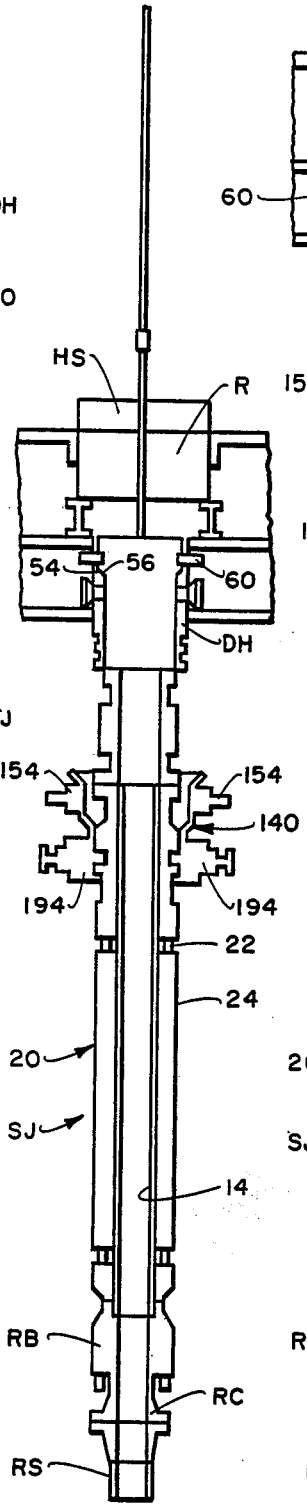
Figure 27:
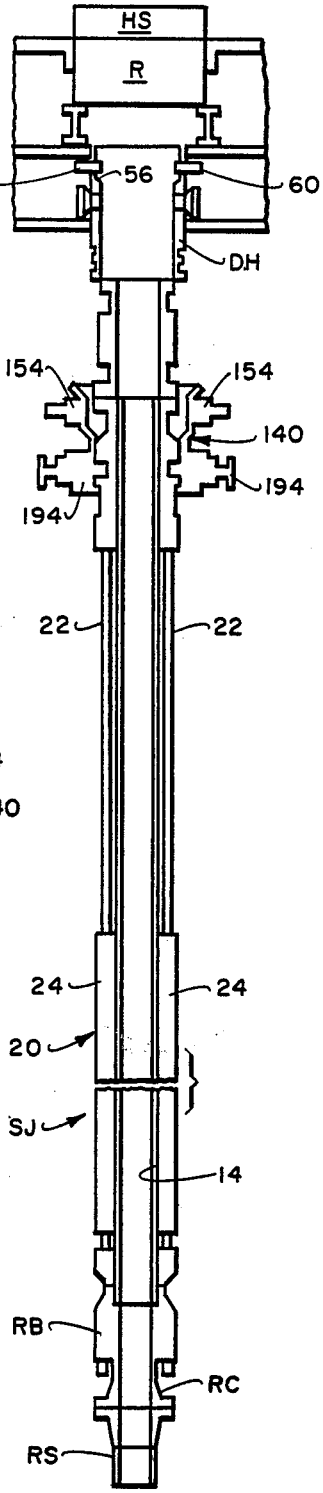
Figure 29:
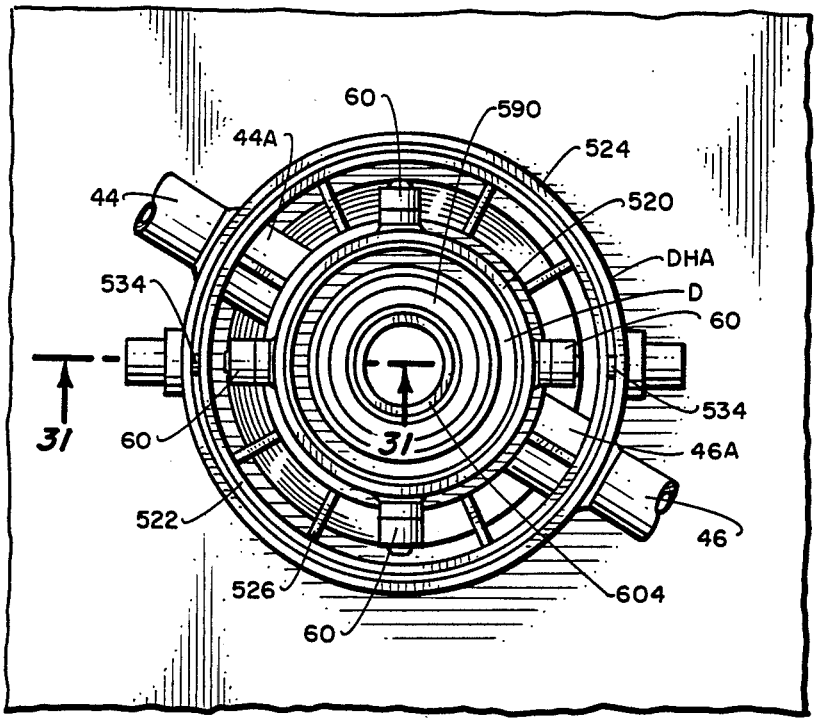
FIG. 29 is a cross-sectional view taken along line 29—29 of FIG. 28.
Figure 30:
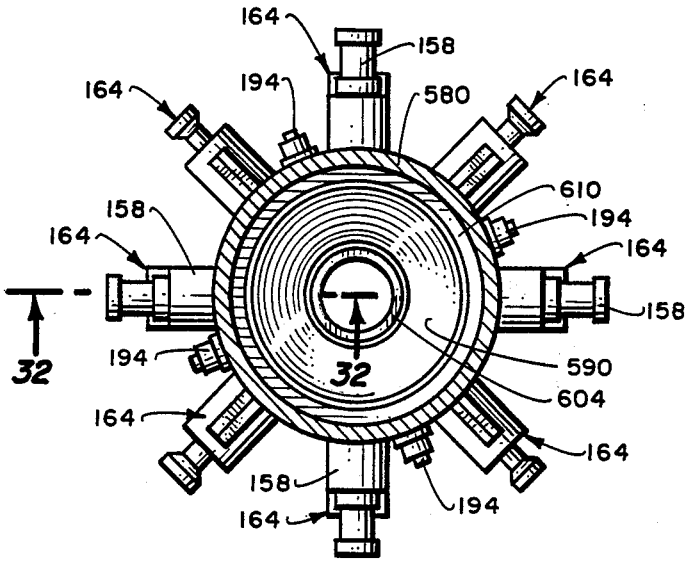
FIG. 30 is a cross-sectional view taken along line 30—30 of FIG. 28.
Figure 31:
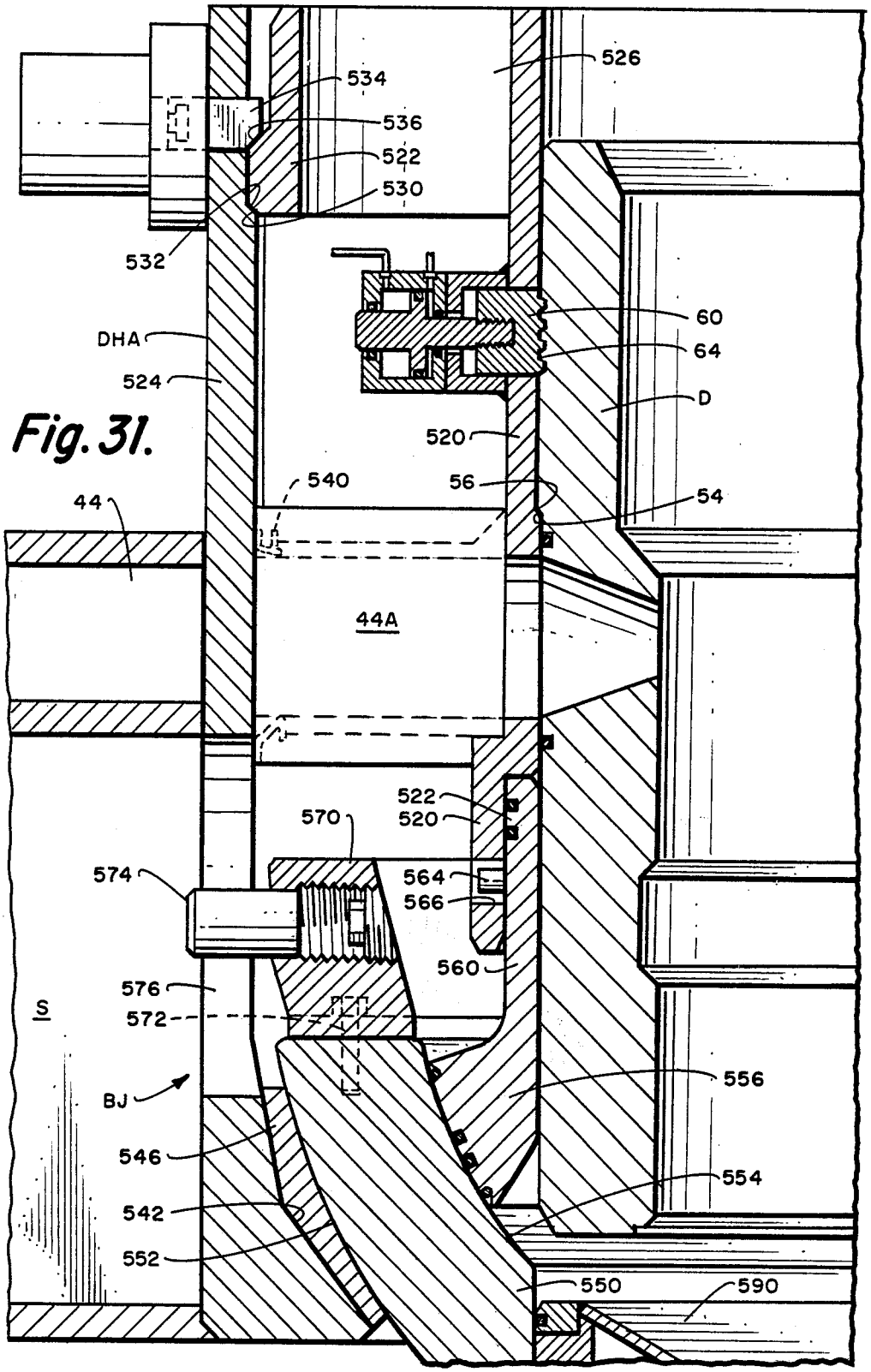
FIG. 31 is an elevational, cross-sectional view of part of the diverter, diverter housing, and ball joint taken along line 31—31 of FIG. 29.

As mentioned previously, FIGS. 2, 13 and 16 illustrate the lock-up dogs 46, air pressure actuated and holding the slip joint SJ in lock-up position as it would be during installation or retrieval. Attention is now directed to FIGS. 24–27 for the steps in making up the upper marine riser package. FIG. 24 illustrates the carrier 140 locked onto the diverter housing DH by lock-up dogs 154. The slip joint SJ and riser rotation bearing RB were first made up, connected to the riser connector RC (FIGS. 2 and 22), and held by the marine riser handling spider HS engaging the spider landing shoulder 106 on the upper spool 12 (FIG. 13). At this time, the carrier 140 is still locked on the diverter housing DH. Next, the diverter D and flex joint FJ are brought over and attached to the upper spool with mating flanges 100, 104. Once this is done, the upper spool is then freed of the riser handling spider HS and lowered through the rotary table until the landing surface 152 on the upper spool orients and lands on the profile 150 of the carrier 140 (FIG. 25). Then, the locking dogs 194 are hydraulically actuated to lock the upper spool 12 onto the carrier 140. This is followed by extending the stab subs 176 into their respective ports through hydraulic actuation of the lines 186. The locking dogs 154 are then retracted and the entire package is lowered until the diverter landing surface 54 lands on the profile 56 on the diverter housing (FIG. 26). The diverter lock-up dogs 60 are then actuated to lock the diverter D in the diverter housing DH. Then, for operation of the self-tensioning slip joint SJ, fluid pressure is applied to the cylinder assemblies 20 to ensure that the slip joint SJ would not drop the full stroke of the piston rods. The applied pressure will be high enough to apply greater tension on the riser string than for normal operation and then the control operator will release the lock-up dogs 42 by air pressure releasing the outer barrel to allow the outer barrel to descend gently by bleeding pressure from the cylinder asemblies till the BOP stack lands and locks on the wellhead. Another possibility is that after the applied pressure is raised above normal, the derrick will be used to support some of the load of the riser string while the control operator releases the lock up dogs 42 and bleeds pressure from the cylinder assemblies to allow the outer barrel to descend gently. Thereafter, the slip joint is set and tensioned at mid stroke, compensating for the rise and fall of the vessel due to tides, waves, and the like to keep the riser string in constant tension.

If it is desired to retrieve the upper marine riser package for any reason, the riser string RS is disconnected at the wellhead and additional fluid pressure is then applied to the cylinder assemblies 20 to raise the outer barrel to the position as shown in FIG. 26 where the lock-up dogs 42 can again lock the outer barrel in position. Once the outer barrel is locked in place, and after the diverter lockdown dogs 60 are hydraulically withdrawn, the entire package, including the carrier 140, is raised by handling sub until the locking dogs 154 are level with the grooves 160 on the diverter housing, at which time the locking dogs 154 are pressured into the grooves. The diverter and flexible joint can then be removed separately or together from the upper housing spool 12. Removal of the flexible joint also withdraws the insert 122.

It is important to note that, in connection with this retrieval procedure, that none of the major hydraulic or air connections to the upper marine riser package need to be disconnected, except for a few small air or hydraulic lines that are equipped with quick-disconnect unions.

If it is desired to remove and replace the packer seal assemblies while the upper spool is held by the riser handling spider, a running tool may be inserted into the bore of the inner barrel (the insert 122 having been removed) where it engages a downwardly facing surface 510 (FIG. 13). This downwardly facing surface was previously used to assemble the inner barrel within the outer barrel. With the downwardly facing surface 510 thus engaged, the inner barrel, together with its hanger 112, are hauled through the upper spool to rest the inner barrel hanger on handling spider. The inner barrel is disconnected from its hanger by removing the screws 116 and the split ring 114. Once the inner barrel is freed from it hanger, it is lowered, to free stand on the ledge 512 of outer barrel (FIG. 19). The top of the inner barrel is now below the packer seals, giving that area an open hole. At this time, a J-tool could then engage the J-slots 374 on the top ring 370 of the packer assembly and rotate the top ring so that ring 370 can be removed. Use the same J-tool to retrieve the first packer element or together with the second packer element for repair and replacement.

While the upper marine riser package is in its upper position, it may be feasible to remove any or all of the cylinder assemblies 20 for inspection, repair and/or replacement.

Second Embodiment—Ball Joint Version

Turning now to FIGS. 28–32, there is shown, in part, another embodiment of the upper marine riser package, identified as 10A. In this embodiment, the flexible joint FJ is replaced by a ball joint BJ and modifications are made in the diverter housing DH to the upper spool 12. The remainder of the upper marine riser package remains the same. To simplify the description of this embodiment, the suffix A will be added to those parts which are modified but perform a similar function as those parts described previously. Those parts in this embodiment which are exactly the same in both embodiments will be given the same reference numeral. Thus, the diverter housing DHA comprises an inner cylindrical diverter housing 520, a support frame or ring 522 spaced therefrom, a cylindrical ball joint housing 524 and vent and mud flow connections 44 and 46. The ball joint housing 524 is mounted to the rig platform S by a bolt/flange arrangement as previously described for the first embodiment. The inner wall of the diverter housing 520 is provided with an upwardly facing landing profile 56 for the landing surface 54 on the diverter outer wall. The upper end of the diverter housing 520 is connected to a support frame 522 by a plurality of radially oriented gussets 526. The support frame has a downwardly facing landing surface 530 which engages an upwardly facing profile 532 on the ball joint housing 524 so that the support frame 522 supports the diverter housing. The diverter housing is locked by a plurality of hydraulically actuated lock dogs 534 extending through the ball joint housing and engaging an upwardly facing ledge 536 on the support frame. The hydraulic actuators for the lock down dogs 534 are similar to actuators for the locking dogs 154 shown in FIG. 13.

Between the two housings, connections 44A and 46A are provided for the diversion of gas and drilling mud through the vents 44 and 46 similar to that of FIGS. 2 and 11. Suitable seals, such as metallic seals 540 and O-ring seals, prevent leakage from the outlets. The diverter is locked in its housing by lockdown dogs 60 which engage grooves 64 in the diverter outer wall in a manner similar to that previously described.

The lower end of the ball joint housing 524 is thickened so that its inner surface extends radially inwardly to form a socket 542. To facilitate tilting movement of the ball joint, a replaceable bearing insert 546 coated with TFE based material for low friction is provided between the main ball body 550 and the socket 542. The main ball body 550 is hemispherical on both its inner and outer surfaces 552 and 554. A radially smaller hemispherical segment 556 engages the inner surface 554 and has a cylindrical extension 560 extending upwardly within the diverter housing 520. The diverter housing has an enlarged radius 562 to accommodate the cylindrical extension so that the inner surface of the remainder of the diverter housing and the inner surface of the extension are radially equal to present a smooth bore for the diverter. The smaller hemispherical segment 556 allows tilting action of the main ball body in its socket since the hemispherical segment and its extension are fixed vertically by the diverter housing and rotationally by a anti-rotation pin 564 within a relatively long vertical slot 566 in the diverter housing. Any wear of the bearing inserts 546, the main ball joint segment 550, or on the surface of the hemispherical segment 556 will be accommodated by downward movement of the segment 556 and its extension 560. Suitable sealing means, such as O-ring seals, are disposed in the surface of the hemispherical segment and between the extension and inner wall of the enlarged radius 562 to seal against leakage through the ball joint. A ring 570 is fixed to the top surface of the main ball segment, as by bolts 572, and has a radially extending anti-rotation pin 574 threaded in the ring and extending therefrom into a vertical slot 576 in the outer cylinder to prevent rotational movement, yet allow tilting movement of the ball joint on two axes.

Figure 32:
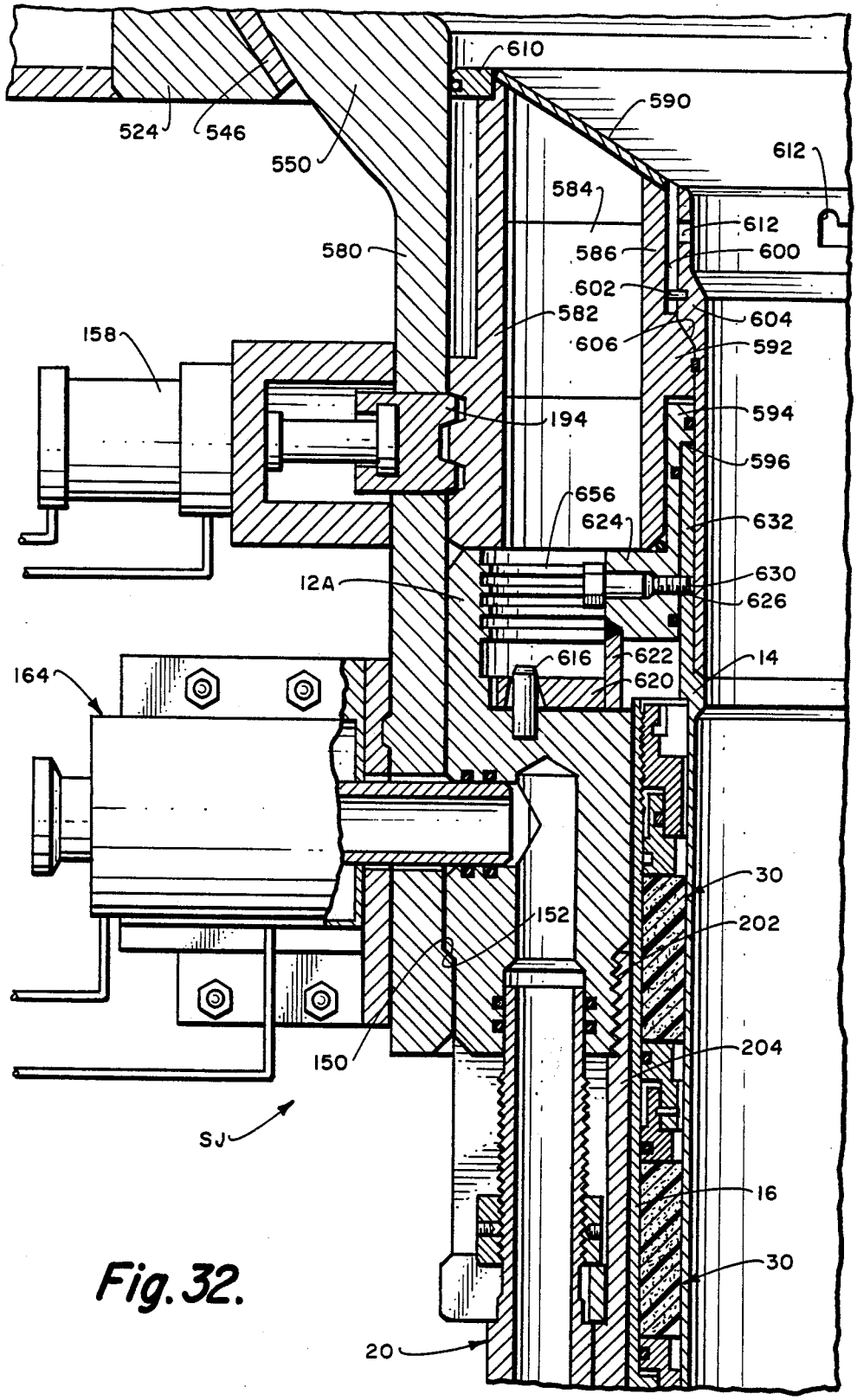
FIG. 32 is an elevational, cross-sectional view of the ball joint extension, locking ring, and packer seal assemblies, etc., taken along line 32—32 of FIG. 30.

The main ball segment 550 has a cylindrical extension 580 directed downwardly and shown integral therewith (FIG. 32). Near its lower end, the extension 580 has a landing profile 150 on its inner wall which engages a shoulder 152 on the upper spool 12A when the upper spool 12A is oriented and landed in the extension. The upper spool 12A serves the same functions as were previously described in the first embodiment, except that the tension load is now transmitted through the ball joint housing 524 to the rig structure, and not through the diverter housing 520. The sequence of installation is also different. The upper large ball joint is, in this case, installed together with hose/stab assembly 164 as a ready package to receive the self-tensioning slip joint SJ.

The upper spool 12A, as in the first embodiment, is part of the self-tensioning slip joint SJ supporting the inner and outer barrels 14 and 16, the tensioning cylinder assemblies 20, the bearing joint RB and the connected risers.

After landing the upper spool 12A, a spool lock-down ring 582 is landed in the ball joint segment extension 580, the inner barrel lock-down dogs 194 are then actuated through windows in the extension to engage mating grooves in the lock-down ring 582, except that the lock-down dogs 194 engage the lock-down ring instead of the upper spool itself. These dogs and their hydraulic actuators are the same type as those described in the first embodiment and need not be described further. This lock-down ring 582 restrains the upper spool from upward movement and its inner wall is provided with gussets 584 to support an inner ring 586. Also, a funnel 590 welded to the two ring 582 and 586 seals off the areas below the diverter by means of an O-ring seal in a ring 610 attached to the outer periphery of the funnel. The inner ring 586 has a thickened portion 592 which extends radially inwardly over an inner barrel hanger 594, thus preventing the inner barrel from upward movement during operation. More precisely, inner ring 586 engages the upper edge of the inner barrel hanger 594 while the latter has a reduced portion forming a downwardly facing surface 596 which engages the top end of the inner barrel. The inside diameters of the ring 586 and the inner barrel hanger 594 coincide with the inner diameter of the inner barrel.

Above the inner barrel hanger 594 and above the radially inner thickened portion 592, the inner ring 586 is provided with a J-slot 600 with a long upwardly extending slot opening to receive a pin 602 in a wear bushing 604. Wear bushing 604 lands within the inner barrel and engages a landing shoulder 606 on the inner ring 586. Suitable seals such as O-ring seals are installed to prevent leakage. J-slots 612 are provided in the vertical portion of the wear bushing 604 for independent removal of the bushing with a running tool.

The upper portion of the upper spool 12A is bored and provided with internal threads 656 to engage mating threads on a running tool for running and retrieving of the self-tensioning slip joint through the rotary table. Retrieving would take place after removal of the wear bushing 604 and lockdown ring 582.

The inner barrel hanger 594 is prevented from rotation by vertical pins 616 in the upper spool extending through a relatively thin ring 620 forming the lower portion of the inner barrel hanger. This ring 620 rests on the upper spool and is attached to a vertical cylindrical ring 622 which is welded to the main ring 624 of the hanger. This main ring 624 has a plurality of threaded bores into which bolts 626 are threaded to engage bores 630 in the inner barrel to hold the latter relative to the hanger. A vertical cylindrical extension 632 on the ring provides the downwardly facing surface 596 which engages the upper edge of the inner barrel to lock the inner barrel against upward movement.

As can be seen from the drawing, the lower end of the bore of the upper spool is counterbored and threaded, as at 202, to receive the threaded inner sleeve 204. This sleeve and the slip joint are the same as previously described and need not be further described at this point.

Also, it should be apparent that after the spool lock-down ring 582 and wear bushing 604 have been landed, the diverter D is locked down in the diverter housing 520 by diverter lock-down dogs 60.

Since the upper spool 12A at its attendant apparatus and the ball joint BJ differ from the first embodiment, retrieval will necessarily be different.

Now to the method of retrieval, if it is desired to retrieve the upper marine riser package 10A for any reason, the riser string is disconnected at the wellhead and fluid pressure is then applied to the cylinder assemblies 20 to raise the outer barrel to the position where, as before, the lock up dogs 60 can again lock the outer barrel 16 in retracted position. In this position, the diverter lock down dogs 60 are retracted so that the diverter D can be withdrawn from the housing DHA.

After the lockdown block 582 has been removed, the upper spool 12A, the packer seal assemblies 30, and the inner and outer barrels 14 and 16 may be retrieved through the diverter housing 520. If it is required, the diverter housing 522 itself with the hemispherical segment 556 may be withdrawn, with or without the diverter remaining inside, simply by retracting those locking dogs in the locking device 534.

If it is desired to remove the ball body and its extension, the inner spool lockdown dogs 194 will be retracted and a running tool engages the J-slots 612 in the wear bushing to withdraw the wear bushing and lock-down block 582 exposing the threads 656 on the upper spool. A running tool will engage the threads 656 and withdraw the upper spool, together with the self-tensioning slip joint and riser string. At this time, the main ball segment 550 can be removed for service or for replacing the bearing insert 546.

In order to change the packer seal assembly, the diverter and the lock down ring 582 and wear bushing 604 must first be removed. A tool is lowered to engage the surface 596 on the inner barrel and retrieve the inner barrel hanger 594 onto the handling spider. While the inner barrel is partially supported by the retrieving tool, the bolts 626 are removed from the slots 630 on the inner barrel separating the hanger from the inner barrel which is then lowered down to free-stand inside the outer barrel below the packer seal assembly. Thus, the J-slots in the upper stepped ring of the packer seal assembly is exposed. A running tool can engage these J-slots, rotate the upper rings and remove the packer seal assemblies.

Therefore, it can be seen that the marine package is easily made up and easily retrievable for repair and maintenance in a manner similar to the repair and maintenance of the first embodiment, except for the details required because of the difference between the ball joint and the flex joint.

Figure 33:
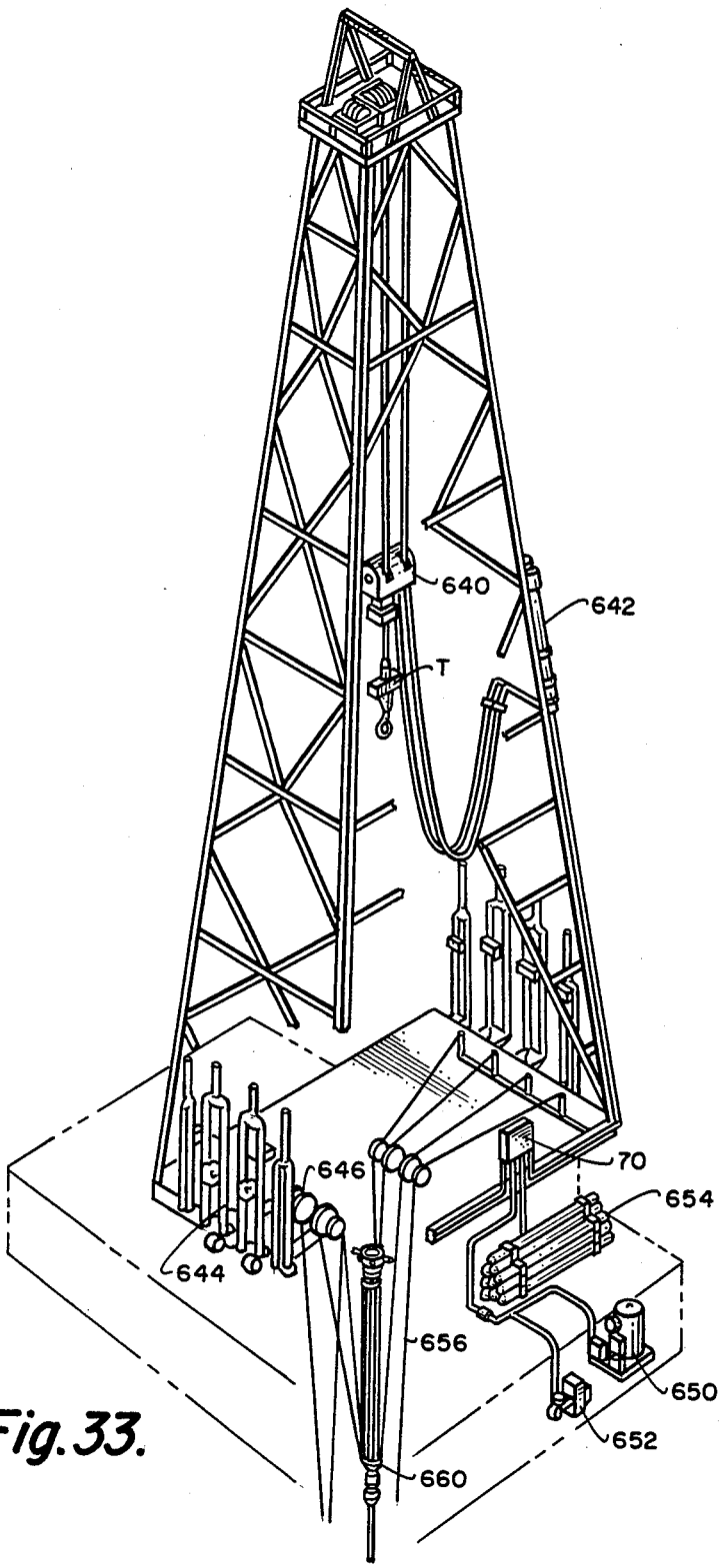
FIG. 33 is a perspective view of this invention as an addition to the conventional riser tensioning systems on a rig.

As mentioned previously, the upper marine riser package 10 or 10A may be used to rid the rig of the equipment necessary to operate the conventional riser tensioning system or, since the package is completely, or substantially completely, below the platform of the rig, it can be used as an addition to the conventional riser tensioning system to provide greater load capabilities for the tensioning system. To accomplish this, attention is now directed to FIG. 33 which shows the derrick, traveling block T and support platforms previously referred to in FIG. 1. The traveling block T is provided with a motion compensator unit 640 and accumulator 642 for vessel motion compensation for the drill pipe P (not shown in this Figure). In this Figure, the riser tensioner units 644, idler sheaves 646, operator controlled pressure system 70 to control fluid supply unit 650, air dryer/compressor unit 652 and air bottle assembly 654 for the conventional riser system are shown. The wire rope 656 for connecting the conventional riser tensioning system is shown connected to a tensioning ring 660 in the conventional manner. Thus far described, the system is conventional; however, also shown is the upper marine riser package 10 which is used in conjunction with the conventional riser tensioning system. Since both are connected to the same operator control panel 70 and to the same fluid and air supply system the two are compatible to increase the load capabilities of the rig for deeper and deeper water operations.

The foregoing teaches those skilled in this art about apparatus and methods of running a marine riser package through a confined space in a floating rig; however, it should also be apparent that a self tensioning slip joint made up of a plurality of peripheral cylinder assemblies, such as disclosed, which is supported and operated below the rig, is useful apart from the disclosed package and an operator may use other equipment than that disclosed to support such a slip joint in operation.

It should also be apparent to those skilled in the art that there are a number of individual features which are unique and useable apart from the two embodiments of the upper marine riser packages disclosed. These are:

the hose/stab assemblies, the combination of the hose/stab assemblies and the upper spools as a means of communicating fluid pressure to the cylinder assemblies, the key slot assembly between the inner and outer barrels of the slip joint, the cylinder assemblies having hollow piston rods as a means of communicating fluid pressure to the cylinder assembly chambers, the connection of the cylinder assemblies to the slip joint and the ability to change the individual cylinder assemblies, the manner in which the packer seals may be changed, that is, centrally and upwardly from between the inner and outer barrels, lock dogs which are air motor driven, the manner of arranging the slip joint wherein the inner barrel does not support the load (riser strings, etc.) in operation, the rotation bearing in a slip joint with or without the lock/unlock devices and gear assembly, and the lock/unlock devices and gear assembly to rotate the riser string relative to the floating vessel.

Finally, while the foregoing continually refers to drilling risers, it should also be apparent to those skilled in the art that the upper marine riser package of this invention may also be used with production or sales risers.

We claim:

1. An upper marine riser package, operable from a relatively moveable structure, such as on a floating vessel which is subject to movement by wave action and the like, and adapted to be connected and lowered through a confined opening such as a rotary table in the vessel and supportable on a diverter housing on the vessel, said package comprising:

a diverter for diverting drilling fluid and gas from a subsea, well, a tilting means connected to said diverter to allow tilting movement between said diverter, diverter housing, vessel and the remainder of said package, a slip joint with riser tensioning means forming part thereof connected to said tilting means to compensate for vertical movement between said well and said vessel, said slip joint comprising an inner barrel and an outer barrel, the inner barrel being sized to telescope within said outer barrel and further including means supporting said inner barrel with respect to said diverter housing, and a plurality of cylinder assemblies connected to said support means and to said outer barrel and subject to said fluid pressure within said cylinder assemblies to compensate for vertical motion of said vessel, and a rotation bearing connected to part of said slip joint to allow rotational movement between said well and said part, said package being connectable to a string of risers and lowered through said confined opening and said diverter housing and to a source of air and fluid under pressure for operating said package.

2. The package as claimed in claim 1 further including sealing means between said inner and outer barrels to prevent leakage therebetween.

3. The package as claimed in claim 2 wherein said cylinder assemblies each comprise an outer cylinder and an inner reciprocable piston rod, said piston rod being releasably connected to said support means and said cylinder being releasably connected to said outer barrel.

4. The package as claimed in claim 3 wherein said piston rod is hollow and connectable to said source of fluid pressure as a means of introducing fluid pressure into said cylinder assembly.

5. The package as claimed in claim 4 wherein said support means comprises a centrally bored cylindrical spool having a plurality of bores for the communication of said fluid pressure to said piston rods.

6. The package as claimed in claim 5 wherein said support means include a carrier ring having means for connecting said carrier ring to said diverter housing to support part of said package on said diverter housing at one position and having means cooperable with said support means to support said package at a second position.

7. The package as claimed in claim 6 wherein said carrier ring includes means cooperable with said bores in said spool for introducing fluid pressure into said cylinder assemblies, said means for introducing fluid pressure comprising of plurality of hose/stab assemblies including means insertable through said carrier ring and into said spool and connectable to said source of fluid pressure.

8. The package as claimed in claim 7 wherein each hose/stab assembly comprises means responsive to said fluid pressure to urge said insertable means into one of said bores and to withdraw said insertable means from said one bore.

9. The package as claimed in claim 8 including means for pressurizing said sealing means to urge said sealing means against said inner barrel.

10. The package as claimed in claim 9 further including means operable to lock said inner and outer barrels together in one position and operable to release said outer barrel from said inner barrel so said outer barrel may be controllable by said cylinder assemblies.

11. The package as claimed in claim 10 wherein said support means includes means cooperable with a riser spider handling system on said vessel to support said riser string, rotation bearing and slip joint while said tilting means and diverter are being connected to said slip joint.

12. The package as claimed in claim 11 wherein means are provided to vent the piston side of said cylinder assemblies to atmosphere to allow said pistons to reciprocate within said cylinders.

13. The package as claimed in claim 12 wherein said vent means includes manifold surrounding said outer barrel and connected by a plurality of lines to each of said cylinders.

14. The package as claimed in claim 13 wherein said tilting means includes an upper tubular member connectable to said diverter and a lower tubular member connectable to said barrel support means, and elastomeric bearing means between said upper and lower body members.

15. The package as claimed in claim 14 wherein said tilting means further includes seal means between said upper and lower tubular members.

16. The package as claimed in claim 15 wherein said rotation bearing includes an outer housing connectable to said outer barrel, an inner tubular member telescoped within said outer housing, and bearing means operatively disposed between said outer housing and inner tubular member for relative rotation between said outer barrel and said well.

17. The package as claimed in claim 16 wherein said rotation bearing further includes means coupled to said outer housing and to said inner tubular member to rotate the inner tubular member relative to said outer housing, and means to lock said outer housing against relative rotation when said rotation means is inoperative.

18. The package as claimed in claim 1 wherein said tilting means comprises a ball joint containing said confined opening and wherein the socket of said ball joint is formed on said housing and the hemisphere of said ball joint seats on said socket, said hemisphere containing said confined opening and further includes a replaceable low friction insert between said socket and said hemisphere to facilitate tilting movement, an inner housing within said first mentioned housing and having means to allow tilting movement, but maintain coaxial alignment with said first mentioned housing, said package further including means for supporting said diverter and wherein said slip joint comprises an inner barrel and an outer barrel, the inner barrel being sized to telescope within said outer barrel, means supporting said inner barrel with respect to said housing, and a plurality of cylinder assemblies connected to said support means and to said outer barrel and subject to said fluid pressure within said cylinder assemblies to compensate for vertical motion of said vessel.

19. The package as claimed in claim 18 further including sealing means between said inner and outer barrels to prevent leakage therebetween.

20. The package as claimed in claim 19 wherein said cylinder assemblies each comprise an outer cylinder and an inner reciprocable piston rod, said piston rod being releasably connected to said support means and said cylinder being releasably connected to said outer barrel.

21. The package as claimed in claim 20 wherein said piston rod is hollow and connectable to said source of fluid pressure as a means of introducing fluid pressure into said cylinder assembly.

22. The package as claimed in claim 21 wherein said support means comprises a centrally bored cylindrical spool having a plurality of bores for the communication of said fluid pressure to said piston rods.

23. The package as claimed in claim 22 wherein said support means include a carrier ring having means for connecting said carrier ring to said diverter housing to support part of said package on said diverter housing at one position and having means cooperable with said support means to support said package at a second position.

24. The package as claimed in claim 23 wherein said carrier ring includes means cooperable with said bores in said spool for introducing fluid pressure into said cylinder assemblies, said means for introducing fluid pressure comprising a plurality of hose/stab assemblies including means insertable through said carrying ring and into said spool and connectable to said source of fluid pressure.

25. The package as claimed in claim 24 wherein each hose/stab assembly comprises means responsive to said fluid pressure to urge said insertable means into one of said bores and to withdraw said insertable means from said one bore.

26. The package as claimed in claim 25 including means for pressurizing said sealing means to urge said sealing means against said inner barrel.

27. The package as claimed in claim 26 further including means operable to lock said inner and outer barrels together in one position and operable to release said outer barrel from said inner barrel so said outer barrel may be controllable by said cylinder assemblies.

28. The package as claimed in claim 27 wherein said support means includes means cooperable with a riser spider handling system on said vessel to support said riser string, rotation bearing and slip joint while said tilting means and diverter are being connected to said slip joint.

29. The package as claimed in claim 28 wherein means are provided to vent the piston side of said cylinder assemblies to atmosphere to allow said pistons to reciprocate within said cylinders.

30. The package as claimed in claim 29 wherein said vent means includes manifold surrounding said outer barrel and connected by a plurality of lines to each of said cylinders.

31. The package as claimed in claim 30 wherein said rotation bearing includes an outer housing connectable to said outer barrel, an inner tubular member telescoped within said housing, and bearing means operatively disposed between said outer housing and inner tubular member for relative rotation between said outer barrel and said well.

32. A self-tensioning slip joint for supporting a load beneath a floating vessel and capable of being lowered through a rotating table on said vessel comprising:

an inner barrel, an outer barrel of a size to telescope over said inner barrel, means preventing relative rotation between said barrels, a plurality of cylinder assemblies surrounding said barrels and actuatable in parallel with the major axes of said barrels, said cylinder assemblies each comprising an outer cylinder and a piston rod reciprocal in said cylinder with a piston attached thereto and with said outer cylinder defining a pressure chamber in said cylinder assembly, means for communicating fluid pressure from a high pressure source to said chamber as operating fluid for urging said outer barrel toward a position fully telescoped with said inner barrel, said piston rod being attached to a supporting means which moves to said floating vessel and said cylinder being attached to said outer barrel to compensate for the load.

33. The slip joint as claimed in claim 32 wherein said piston rod is hollow and the piston contains passages connecting said piston rod to said chamber.

34. The slip joint as claimed in claim 33 further including sealing means between said inner and outer barrel.

35. The slip joint as claimed in claim 34 wherein said sealing means are pressurized radially into sealing engagement with said inner barrel.

36. The slip joint as claimed in claim 35 wherein said outer barrel is provided with an upwardly opening cavity to contain said sealing means and said sealing means being provided with means for removing said sealing means upwardly through said confined space while said outer barrel is supported by said housing.

37. The slip joint as claimed in claim 36 further including pneumatically operated means to lock and unlock said barrels in a predetermined relative position.

38. The slip joint as claimed in claim 37 wherein said load comprises drilling or other marine riser.

39. The slip joint as claimed in claim 38 wherein said inner barrel is coupled to a support means and wherein said support means includes means for communicating fluid pressure to said chambers.

40. The slip joint as claimed in claim 39 wherein said barrels and cylinder assemblies are supported below said vessel and of a diameter such that they may be lowered through a rotary table after being connected up to said load.

41. In a self-tensioning slip joint for compensating for vertical movement between a floating vessel and a subsea well, both of which are connected to said slip joint, said slip joint having an inner barrel telescoped over an outer barrel, the improvement comprising, means for supporting said inner barrel on a floating vessel, a plurality of hydraulically actuated cylinder assemblies, means for introducing fluid pressure into said cylinder assemblies to cause said inner and outer barrels to move to compensate for said vertical movement, means for connecting said cylinder assemblies to said outer barrel and to said inner barrel support means for independent relative motion therebetween, sealing means mounted so as to be moveable with said outer barrel in sliding relationship with said inner barrel for fluid tight sealing relationship therebetween, and means for retracting said sealing means from between said inner and outer barrels upwardly through said support means.

42. The slip joint as claimed in claim 41 wherein said cylinder assemblies are releasably connected to said support means and outer barrel so that one or more of said cylinder assemblies may be removed and replaced from said slip joint.

43. The slip joint as claimed in claim 42 wherein said cylinder assemblies include a hollow piston rod and a piston at one end thereof, and means for communicating said fluid pressure through said hollow piston rods and piston to a chamber in said assembly defined by said piston and said cylinder.

44. The slip joint as claimed in claim 43 wherein key means slideably connects said barrels together to prevent relative rotation and to transmit torque therebetween.

45. The slip joint as claimed in claim 44 wherein said outer barrel contains passage connecting a source of fluid pressure to said sealing means to pressurize said sealing means against said inner barrel.

46. For use in offshore drilling, an elongated tubular conduit for connecting a floating vessel to a well bore to pass drilling fluid and drilling tools between said vessel and said well bore, comprising, an elongated inner tubular member and an elongated outer tubular member, means for attaching said outer tubular member to said well bore, means for attaching said inner tubular member to said floating vessel, said tubular members being axially aligned and in overlapping telescopic relations in all positions of said vessel relative to said well bore within selected design limits, cylinder assemblies attached to one of said telescopic members including a piston and rod attached to said inner tubular member, a cylinder surrounding said piston in axial slideable relationship and attached to said outer tubular member, said cylinder being of a sufficient length to permit axial extension and retraction of said tubular members sufficient to accommodate vessel movement relative to said well bore within said design limits, means for supplying pressure fluid to said cylinder for applying substantially continuous force during offshore drilling at a substantially constant preselected upward axial force, the magnitude of said force exceeding the weight of the tubular conduit plus the weight of any load on said tubular conduit.

47. In combination, a floating vessel with a platform having a first riser tensioning means to compensate for wave action on said vessel with respect to a subsea well, said first riser tensioning means having control and actuating means located on and above said platform, a riser string suspended below the vessel, means connecting said first riser tensioning means and said riser string above and below said platform, a second riser tensioning means on said vessel also to compensate for wave motion on said vessel in the same manner as said first riser tensioning means, said second riser tensioning means having actuator means located below said platform and connected to said control means and responsive to said control means, said second riser tensioning means comprising telescoping tubular members with said actuator means located outside said tubular members.

48. The combination as claimed in claim 47 wherein said vessel further includes a riser handling spider with an opening through which said riser string is connected and lowered to be connected to said subsea well, the further improvement in said second riser tensioning means in that said second riser tensioning means including said actuator means is sized to be made up and connected to said riser string and lowered through said opening.

49. The combination as claimed in claim 48 wherein the actuator means of said first riser tensioning means includes hydraulic/pneumatic cylinder assemblies connected to air and hyddraulic pressure sources and operated by said control means, wherein said means connecting said riser string to said first riser tensioning means comprises a plurality of wire ropes each connected at one end to said riser string below said platform and at the other end to said cylinder assemblies, and wherein said actuator means of said second riser tensioning means comprises hydraulic means connected to said source of hydraulic fluid pressure.

50. In a self-tensioning slip joint comprising a pair of telescoping tubular members, one of which is connected for vertical movement to a subsea well and the other which is connected to a floating vessel and having seal means therebetween for slideable fluid tight interaction, the method of removing said sealing means from between said tubular members comprising the steps of;

causing said tubular members to be latched against movement therebetween, and removing said sealing means axially of said cylindrical members.

51. In a vessel having a riser handling spider with an opening through which said riser and other equipment is to be lowered, the steps of making up riser assembly and connecting the same to an upper marine riser package comprises the steps of;

connecting a plurality of risers to make up a riser string, connecting a rotation bearing to a self-tensioning riser slip joint having external actuators, connecting said rotation bearing to the last riser of said string, lowering said rotation bearing and self-tensioning slip joint and its external actuators through said riser handling spider, connecting a tilting means and a diverter to said self-tensioning slip joint, lowering said tilting means and said diverter through said riser handling spider, and supporting said riser string, rotation bearing, self-tensioning slip joint and tilting means through said diverter by said vessel.

* * * * *